US010696366B2

(12) United States Patent
Oh et al.

(10) Patent No.: US 10,696,366 B2
(45) Date of Patent: Jun. 30, 2020

(54) PROPULSION APPARATUS FOR SHIP

(71) Applicant: SAMSUNG HEAVY IND. CO., LTD., Seoul (KR)

(72) Inventors: Se-Myun Oh, Seoul (KR); Hyun-Sang Park, Gyeongsangnam-do (KR); Tae-Goo Lee, Daejeon (KR); Dong-Hyun Lee, Daejeon (KR); Tae-Sik Lee, Gyeongsangnam-do (KR)

(73) Assignee: SAMSUNG HEAVY IND. CO., LTD., Seoul (KR)

( * ) Notice: Subject to any disclaimer, the term of this patent is extended or adjusted under 35 U.S.C. 154(b) by 83 days.

(21) Appl. No.: 15/874,879

(22) Filed: Jan. 19, 2018

(65) Prior Publication Data

US 2018/0178890 A1 Jun. 28, 2018

Related U.S. Application Data

(63) Continuation of application No. 14/398,726, filed as application No. PCT/KR2013/003886 on May 6, 2013, now abandoned.

(30) Foreign Application Priority Data

May 4, 2012 (KR) ..... 10-2012-0047373
May 9, 2012 (KR) ..... 10-2012-0049362
May 9, 2012 (KR) ..... 10-2012-0049371

(51) Int. Cl.
*B63H 5/10* (2006.01)
*B63H 1/04* (2006.01)
(Continued)

(52) U.S. Cl.
CPC ..... *B63H 5/10* (2013.01); *B63H 1/04* (2013.01); *B63H 21/386* (2013.01); *B63H 23/02* (2013.01);
(Continued)

(58) Field of Classification Search
USPC ..... 416/128; 415/124, 122.1, 68, 69
See application file for complete search history.

(56) References Cited

U.S. PATENT DOCUMENTS 2,058,361 A 10/1936 Sherwood et al.
3,752,281 A * 8/1973 Arnold ..... F16D 25/123 252/62.51 C
(Continued)

FOREIGN PATENT DOCUMENTS

CN 1087592 6/1994
CN 2217132 1/1996
(Continued)

OTHER PUBLICATIONS

Extended European Search Report dated Mar. 21, 2019 for European Patent Application No. 18202155.0.
(Continued)

*Primary Examiner* — Ninh H. Nguyen
*Assistant Examiner* — Behnoush Haghighian
(74) *Attorney, Agent, or Firm* — Ladas & Parry, LLP

(57) ABSTRACT

Provided is a ship propelling apparatus including a rotation shaft on which a rear propeller is fixed; a front propeller rotatably supported on the rotation shaft in front of the rear propeller; and a counter-rotating device through which the rotation shaft passes, which includes a gear box including therein a plurality of gears configured to reverse rotation of the rotation shaft and transfer the reversed rotation to the front propeller, and which is installed in an installation space formed at the rear of a ship. The rotation shaft includes a measurement hole formed to pass through a center of the rotation shaft for centering of the counter-rotating device installed in the installation space; and an individual lubricant path separated from the measurement hole.

6 Claims, 26 Drawing Sheets

(51) Int. Cl.

| | |
|---|---|
| ***B63H 21/38*** | (2006.01) |
| ***B63H 23/02*** | (2006.01) |
| *B63H 23/32* | (2006.01) |
| *B63H 23/34* | (2006.01) |

(52) U.S. Cl.
CPC ..... *B63H 23/321* (2013.01); *B63H 2005/106* (2013.01); *B63H 2023/0283* (2013.01); *B63H 2023/322* (2013.01); *B63H 2023/323* (2013.01); *B63H 2023/327* (2013.01); *B63H 2023/342* (2013.01); *B63H 2023/346* (2013.01)

(56) References Cited

U.S. PATENT DOCUMENTS

| | | | | | |
|---|---|---|---|---|---|
| 4,642,059 | A * | 2/1987 | Nohara | B63H 5/10 | 416/129 |
| 4,790,782 | A * | 12/1988 | McCormick | B63H 5/10 | 416/128 |
| 4,792,314 | A * | 12/1988 | McCormick | B63H 5/10 | 416/129 |
| 4,864,709 | A * | 9/1989 | Klucz | B25B 27/023 | 29/259 |
| 5,030,149 | A * | 7/1991 | Fujita | B63H 23/30 | 440/75 |
| 5,697,821 | A * | 12/1997 | Ogino | B63H 5/10 | 440/80 |
| 5,795,200 | A * | 8/1998 | Larkin | B64C 11/48 | 440/81 |
| 6,316,298 | B1 | 11/2001 | Lee | | |
| 2007/0126148 | A1 * | 6/2007 | Coyle | B29C 33/305 | 264/299 |
| 2011/0033296 | A1 | 2/2011 | Shuto et al. | | |
| 2015/0098824 | A1 | 4/2015 | Oh et al. | | |

FOREIGN PATENT DOCUMENTS

| | | |
|---|---|---|
| CN | 2934709 | 8/2007 |
| CN | 201405325 | 2/2010 |
| CN | 101909986 | 12/2010 |
| CN | 201842242 | 5/2011 |
| CN | 202100618 | 1/2012 |
| CN | 202220919 | 5/2012 |
| EP | 0 418 599 | 3/1991 |
| EP | 2 230 172 | 9/2010 |
| EP | 2236408 | 10/2010 |
| JP | 3-72099 | 7/1981 |
| JP | 60-121191 | 6/1985 |
| JP | 60-107461 | 7/1985 |
| JP | 61-110045 | 5/1986 |
| JP | 62-279189 | 12/1987 |
| JP | 63-105600 | 7/1988 |
| JP | 1-237289 | 9/1989 |
| JP | 5-85475 | 4/1993 |
| JP | 5-193563 | 8/1993 |
| JP | 6-56086 | 3/1994 |
| JP | 7-10085 | 1/1995 |
| JP | 7-52881 | 2/1995 |
| JP | 8-74854 | 3/1996 |
| JP | 9-315390 | 12/1997 |
| JP | 2000-110807 | 4/2000 |
| JP | 2000-168682 | 6/2000 |
| JP | 2004-314897 | 11/2000 |
| JP | 2009-12746 | 1/2009 |
| JP | 2009-518196 | 5/2009 |
| JP | 2009-161050 | 7/2009 |

OTHER PUBLICATIONS

Office Action dated Aug. 1, 2017 for Chinese Patent Application No. 201610563137.7 and its English machine translation by Google Translate.

Office Action dated Aug. 2, 2017 for Chinese Patent Application No. 201610563139.6 and its English machine translation by Google Translate.

Office Action dated Sep. 26, 2017 for European Patent Application No. 13784532.7.

Extended European Search Report dated Jul. 4, 2016 for European Patent Application No. 13784532.7.

Final Office Action dated Jun. 28, 2016 for Japanese Patent Application No. 2015-510194 and its machine English translation provided by Applicant's foreign counsel.

Office Action dated Feb. 7, 2017 for Japanese Patent Application No. 2015-244529 and its machine English translation provided by Global Dossier.

Partial Supplementary European Search Report dated Feb. 5, 2016 for European Patent Application No. 13784532.7.

Office Action dated Mar. 2, 2016 for Chinese Patent Application No. 201380023542.4 and its English machine translation by Google translate.

International Search Report for PCT/KR2013/003886 dated Jul. 9, 2013 and its English translation provided by WIPO.

International Preliminary Report on Patentability (Chapter II) for PCT/KR2013/003886 dated Jul. 23, 2014 and its English translation provided by WIPO.

Written Opinion of the International Searching Authority for PCT/KR2013/003886 dated Jul. 9, 2013 and its English machine translation by Google Translate.

Office Action dated Sep. 15, 2015 for Japanese Patent Application No. 2015-510194 and its English machine translation provided by Applicant's foreign counsel.

Final Office Action dated Aug. 31, 2017 for U.S. Appl. No. 14/398,726 (now published as US 2015/0098824).

Non-Final Office Action dated Apr. 18, 2017 for U.S. Appl. No. 14/398,726 (now published as US 2015/0098824).

Restriction Requirement dated Jan. 11, 2017 for U.S. Appl. No. 14/398,726 (now published as US 2015/0098824).

* cited by examiner

[FIG. 1]
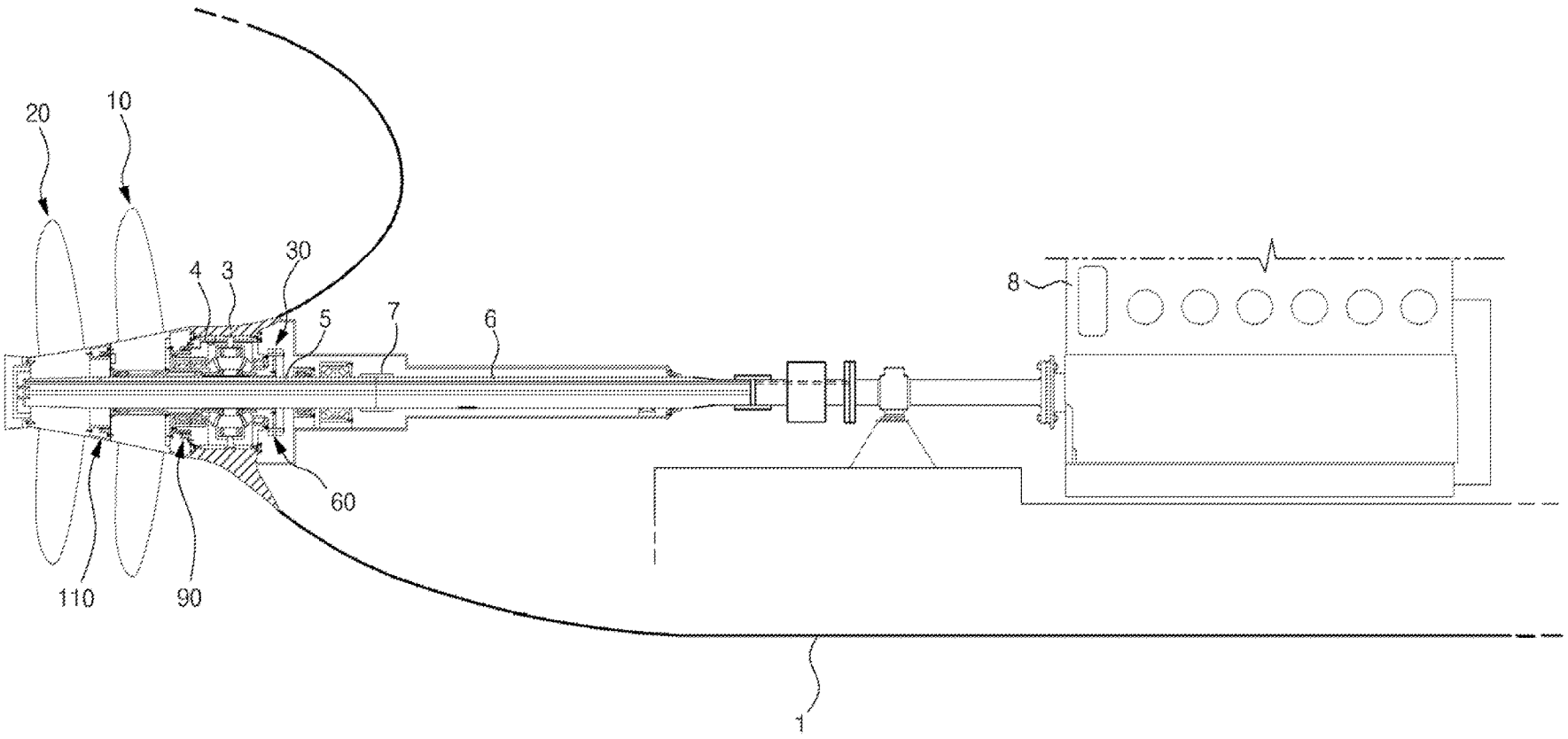

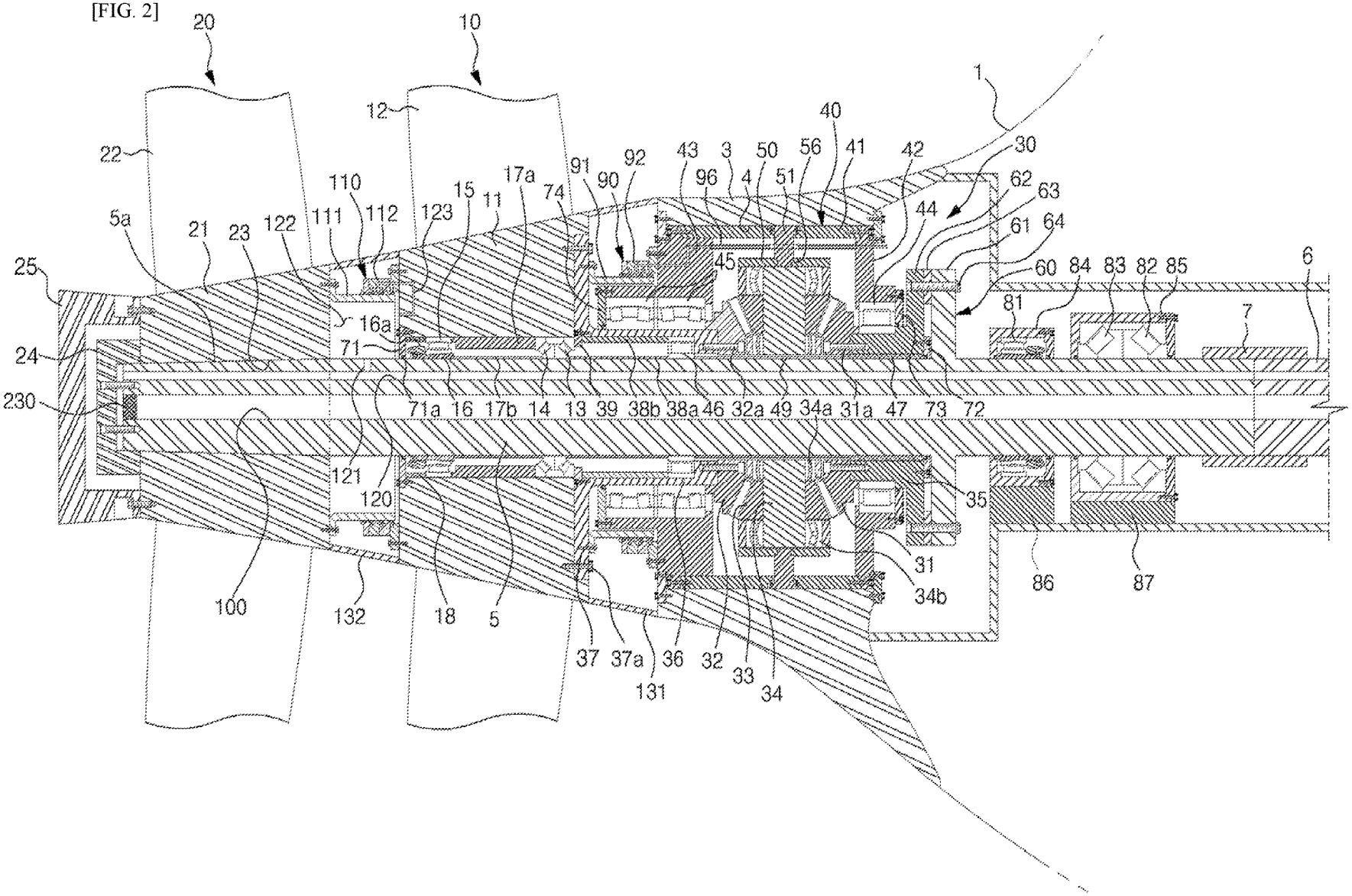
[FIG. 2]

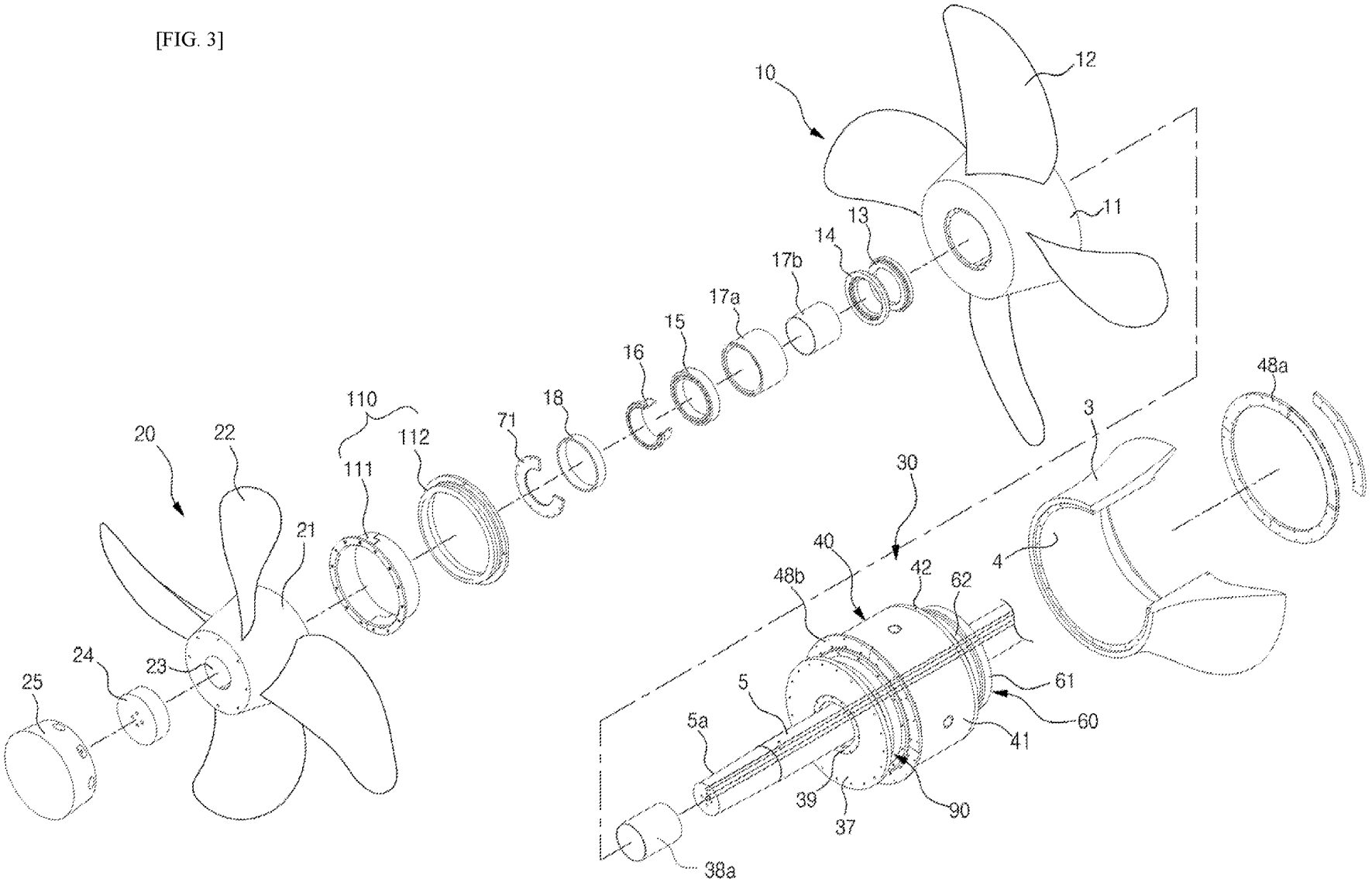
[FIG. 3]

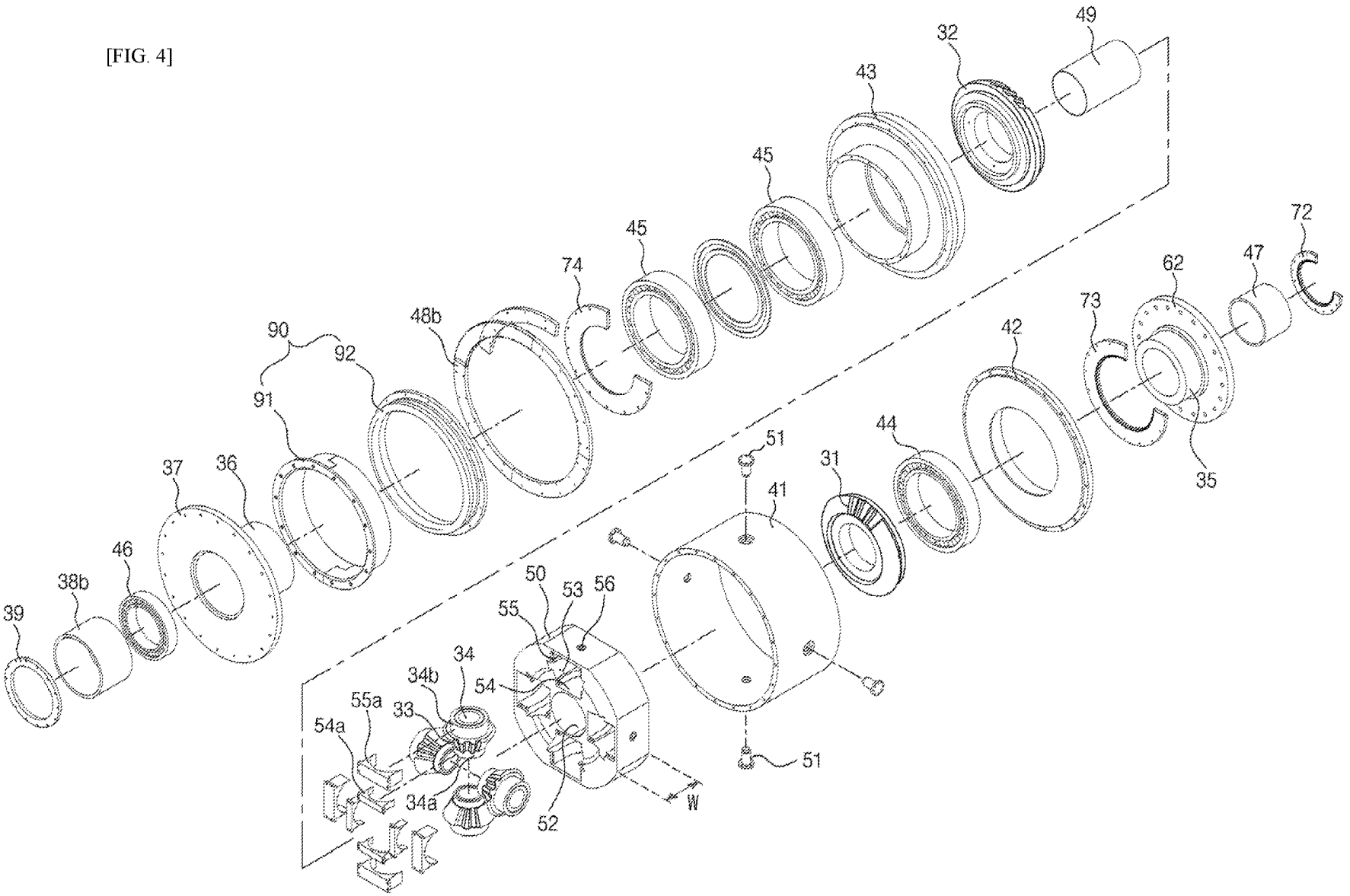
[FIG. 4]

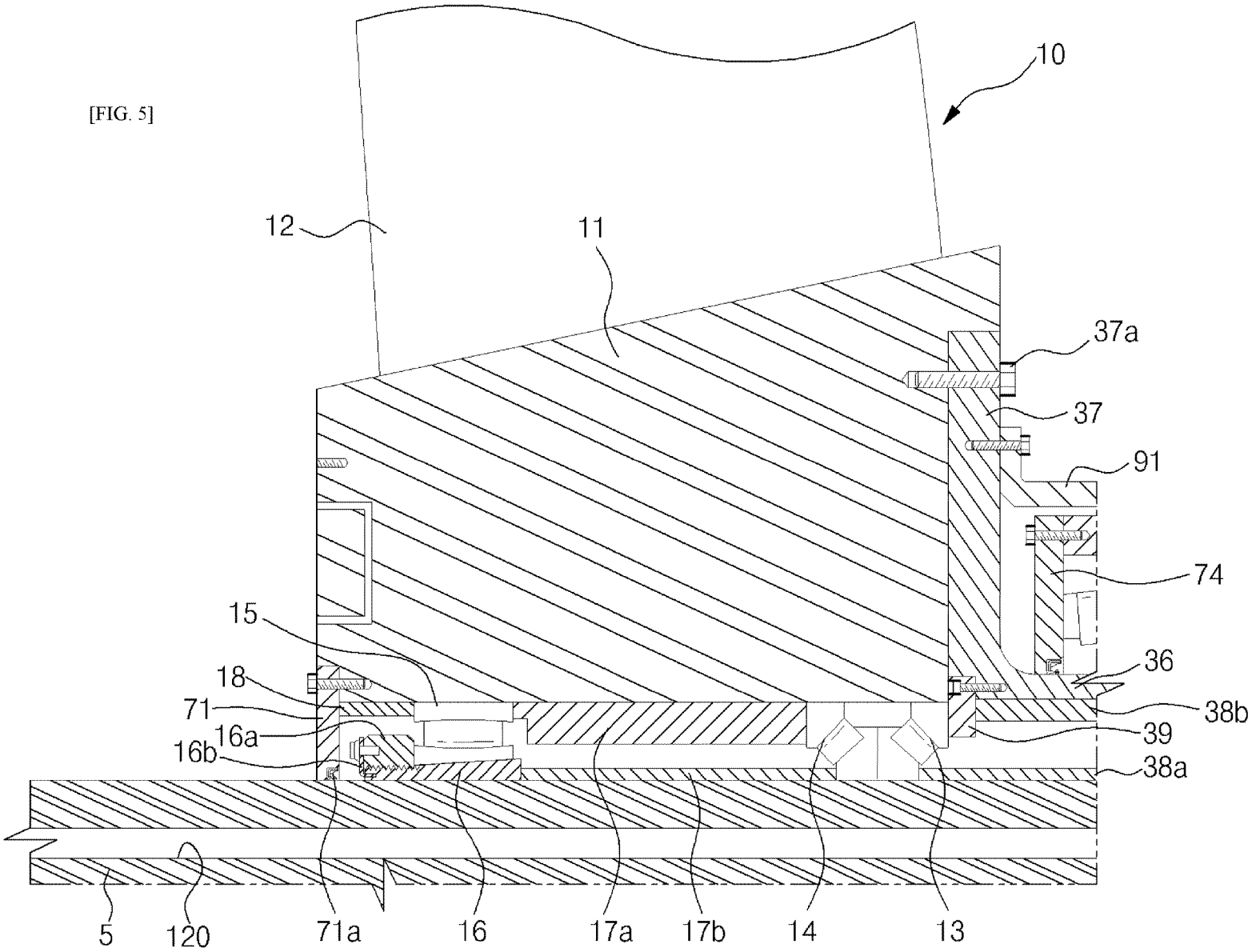
[FIG. 5]

[FIG. 6]
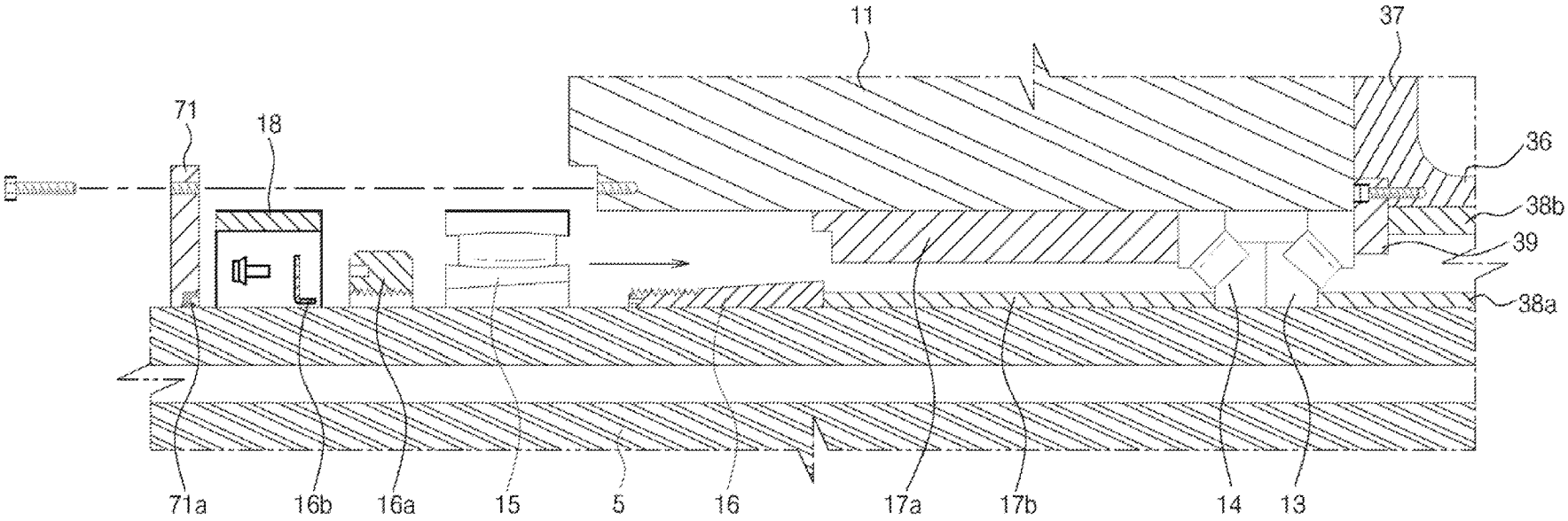

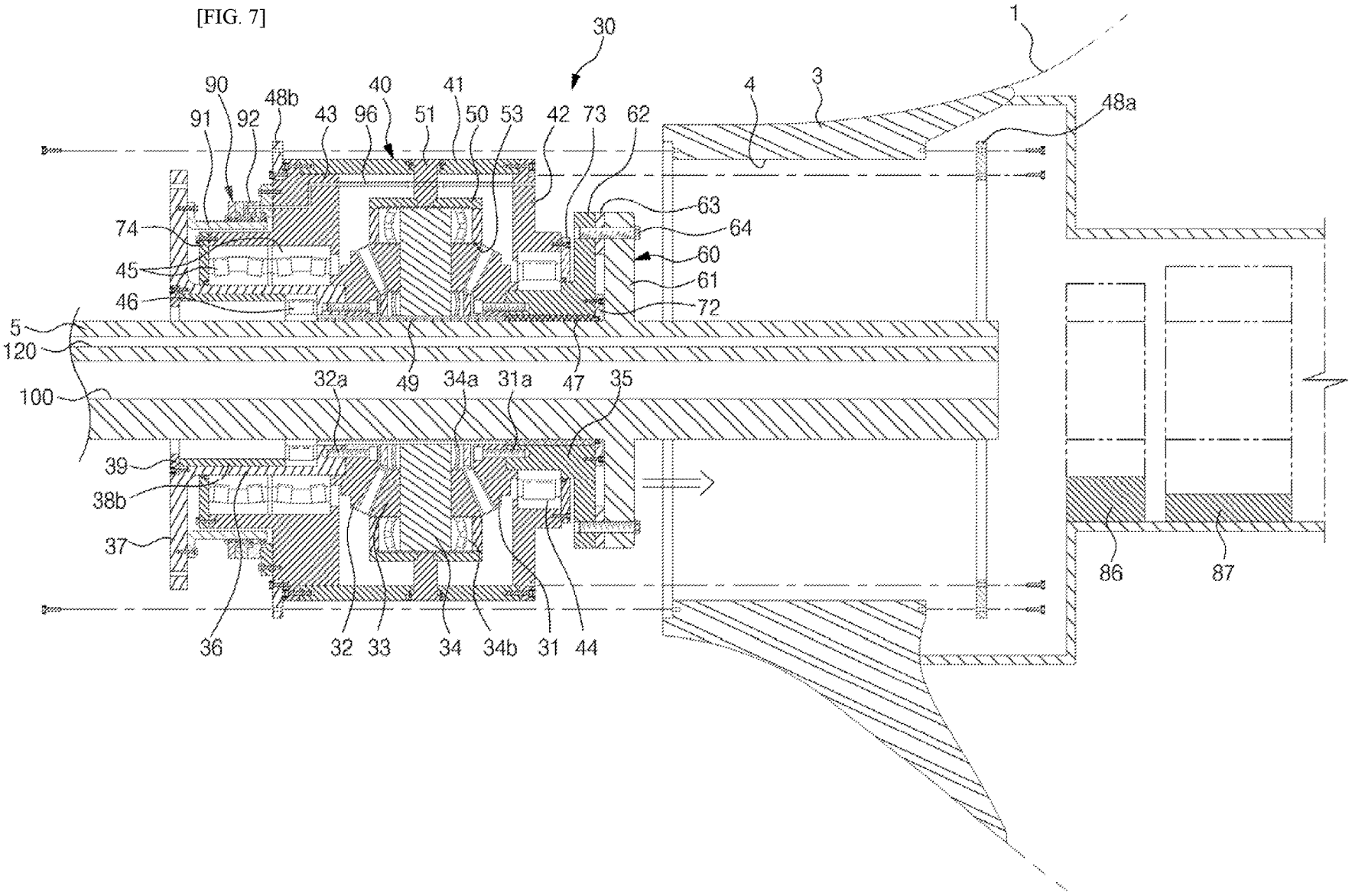
[FIG. 7]

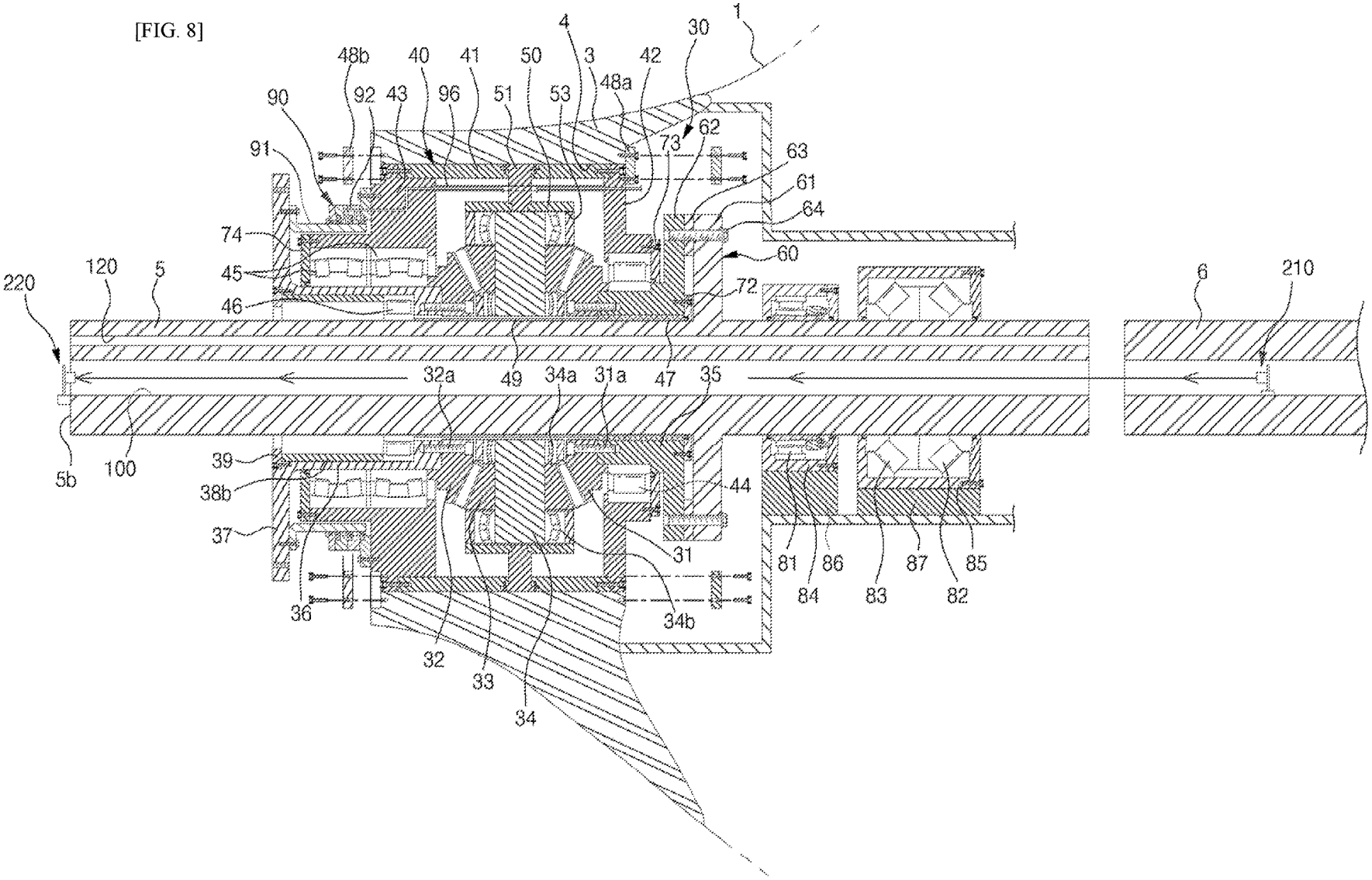
[FIG. 8]

[FIG. 9]
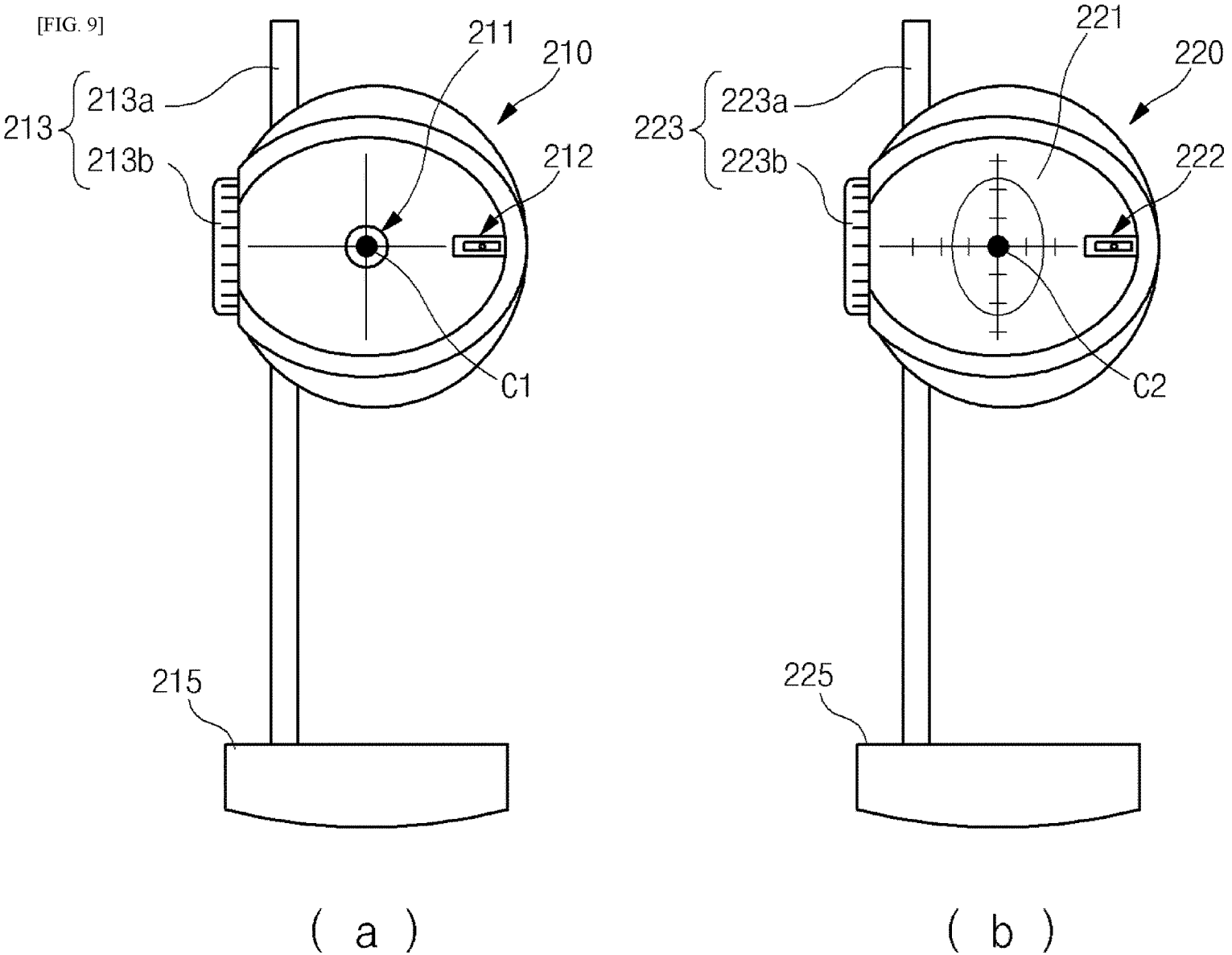

[FIG. 10]
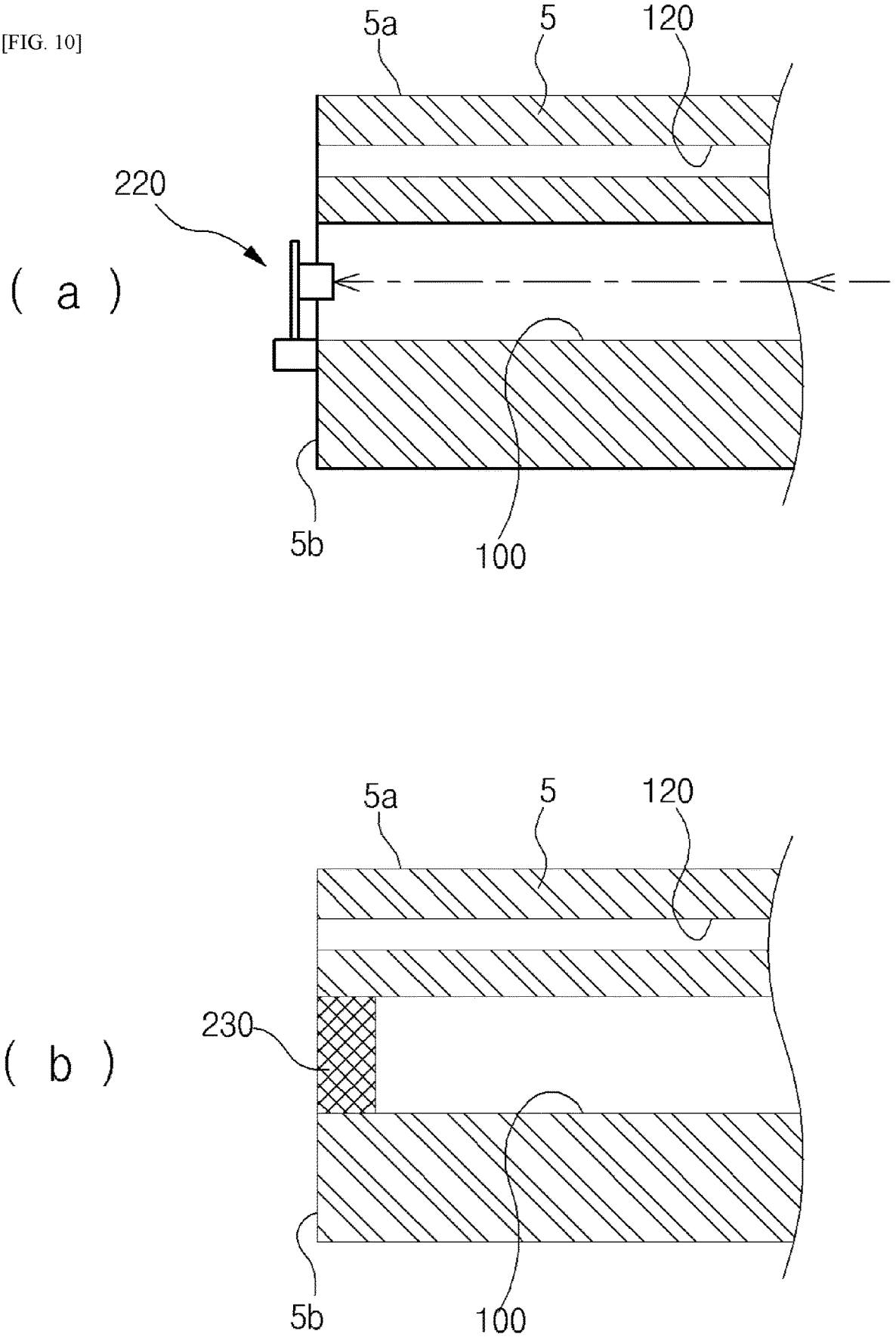

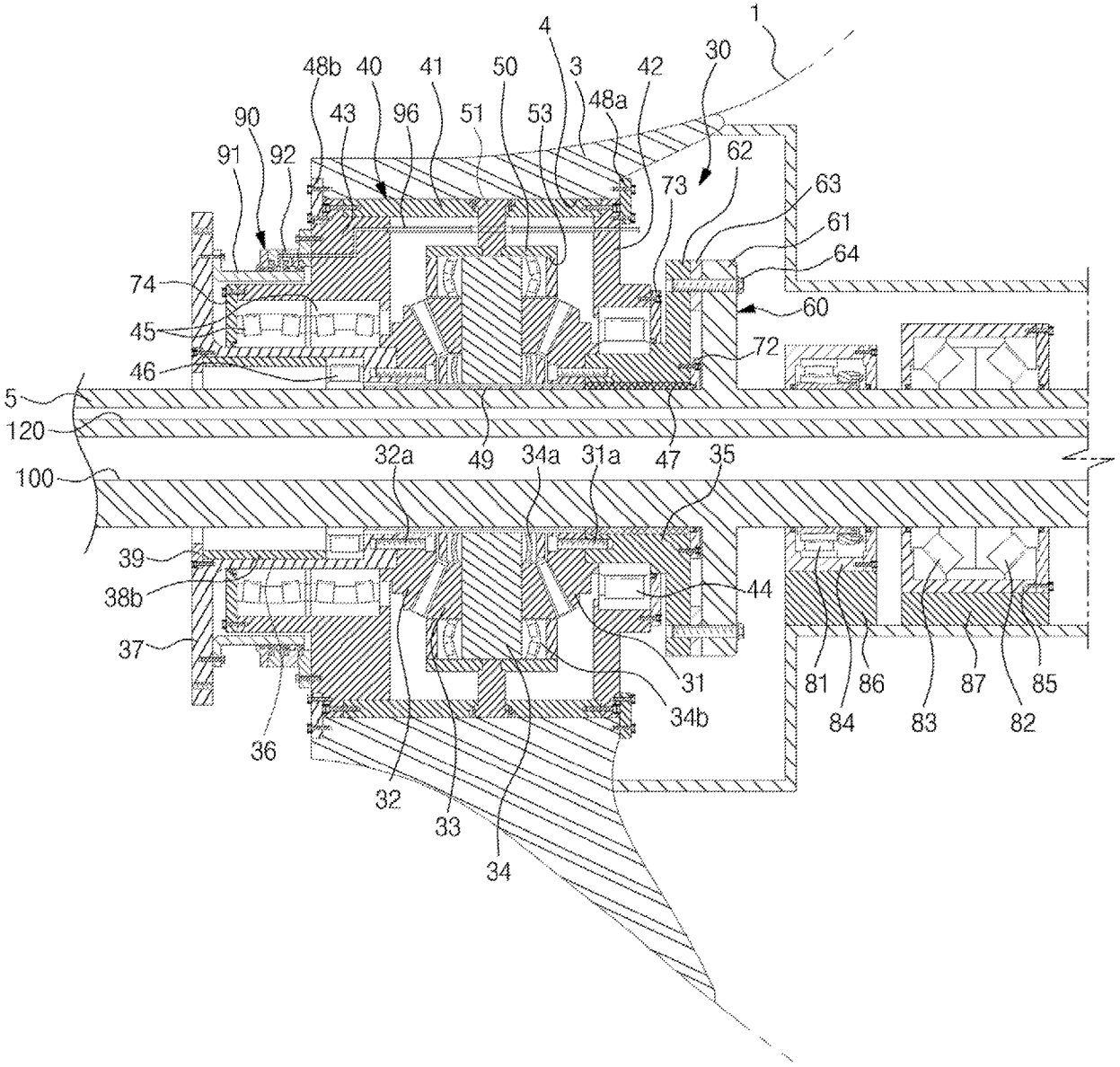
[FIG. 11]

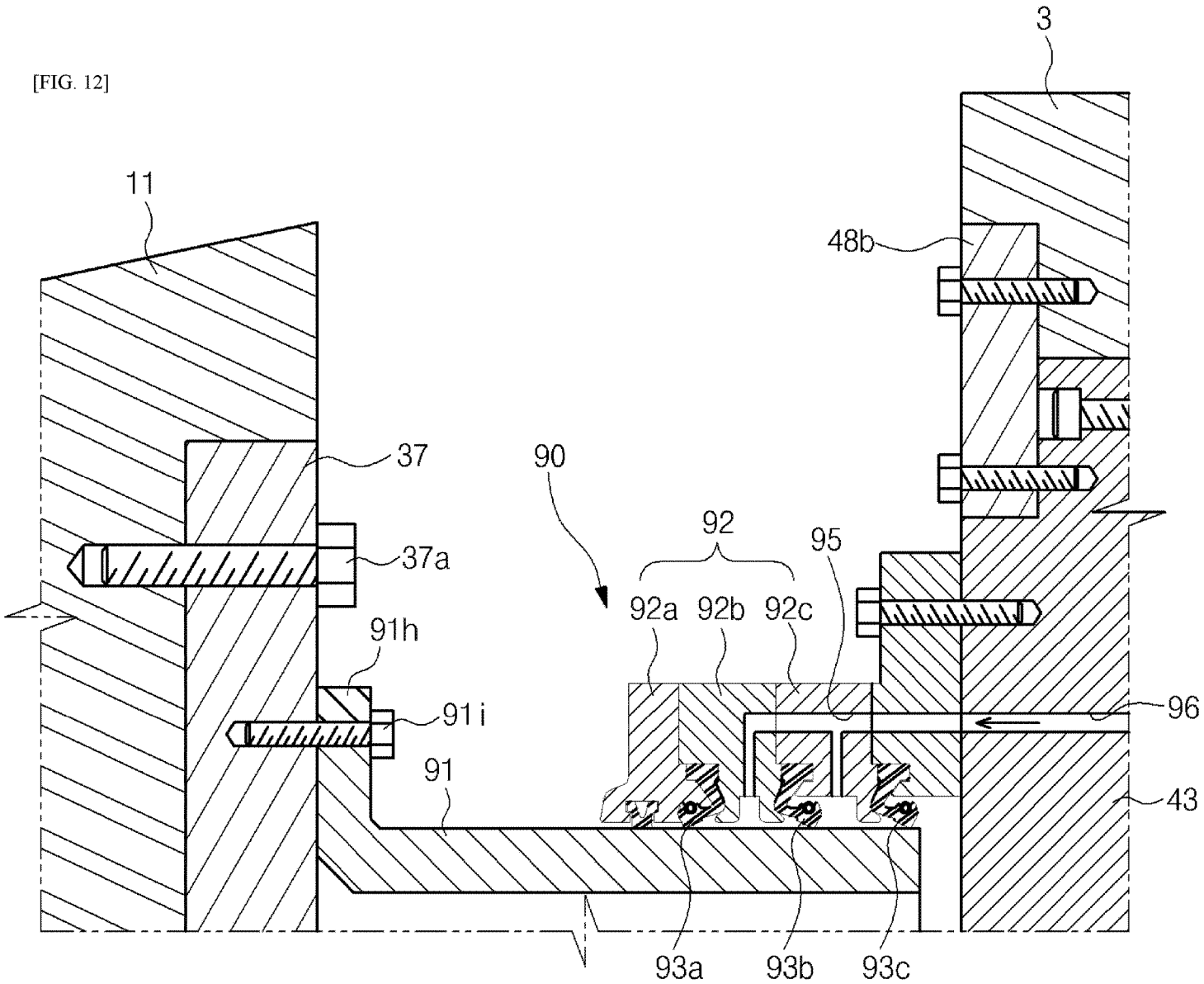
[FIG. 12]

[FIG. 13]
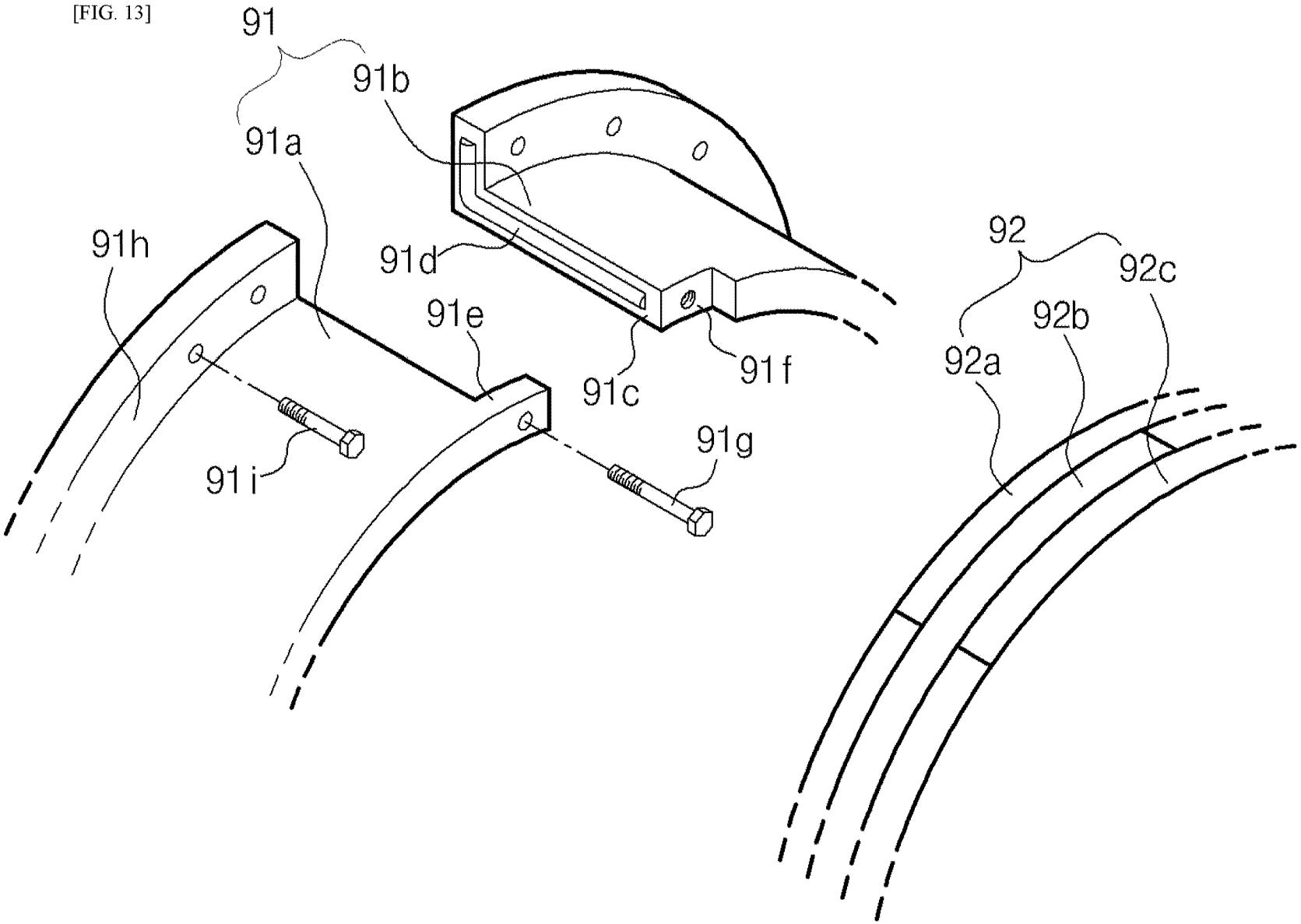

[FIG. 14]
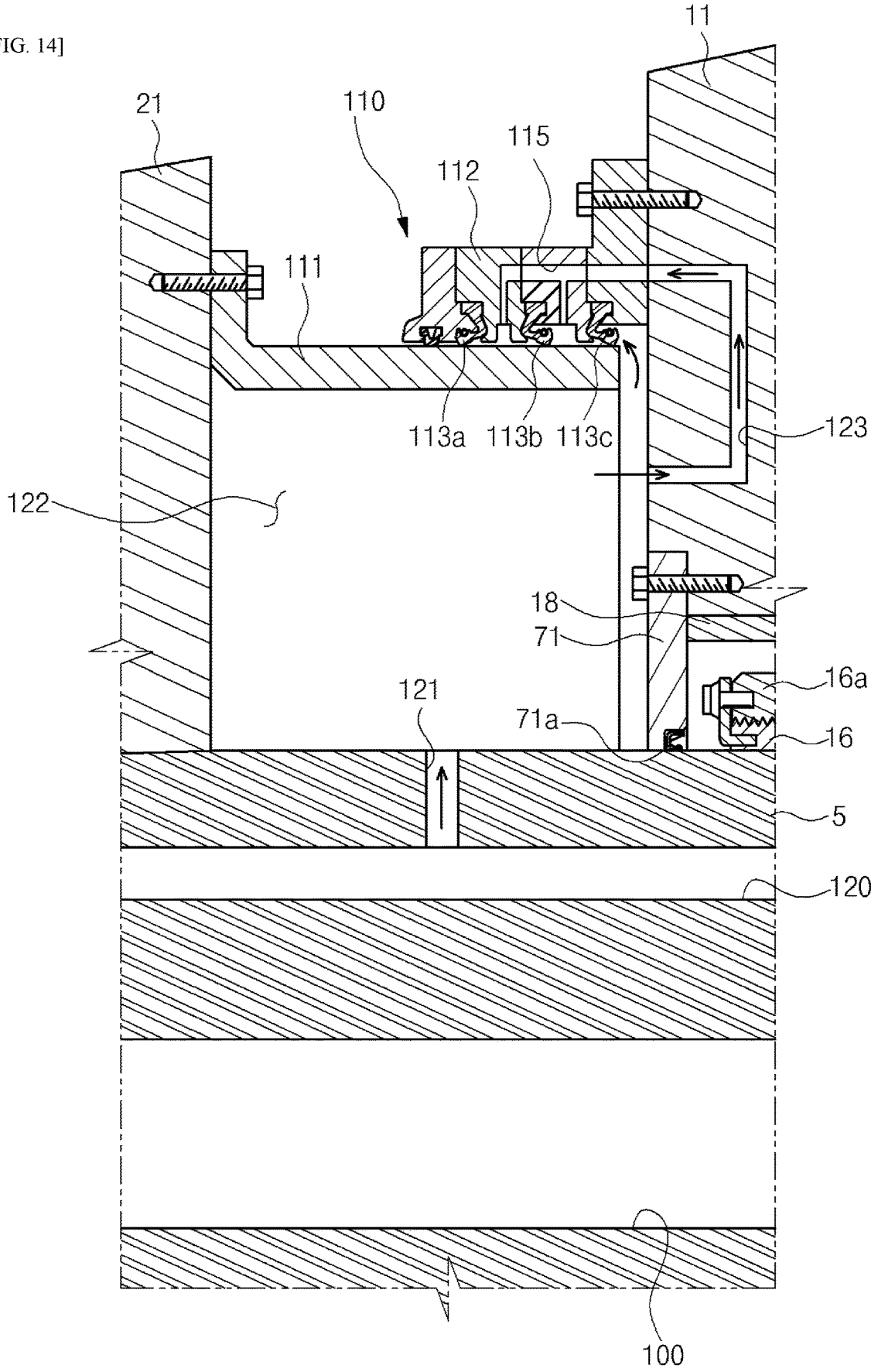

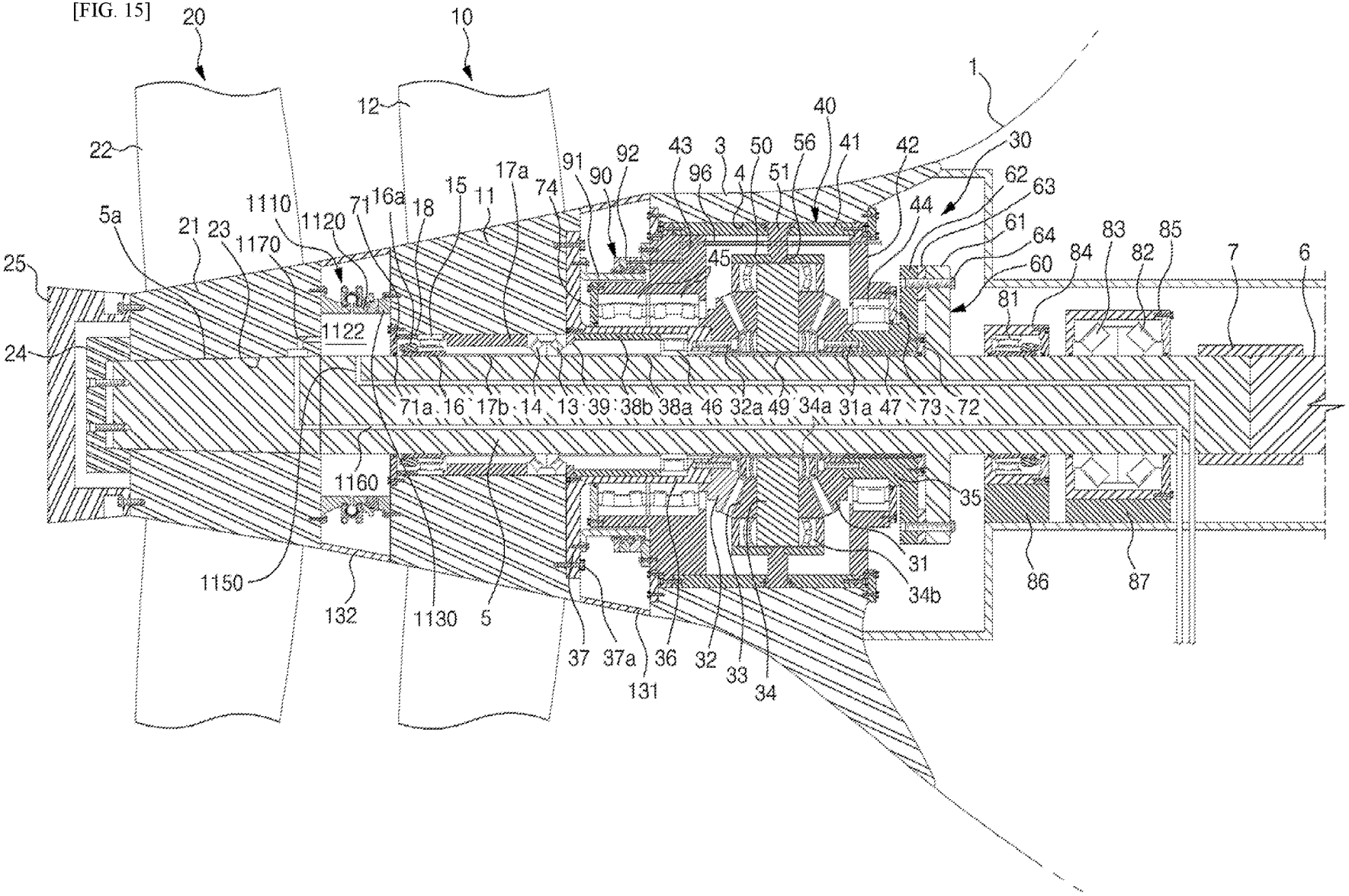
[FIG. 15]

[FIG. 16]
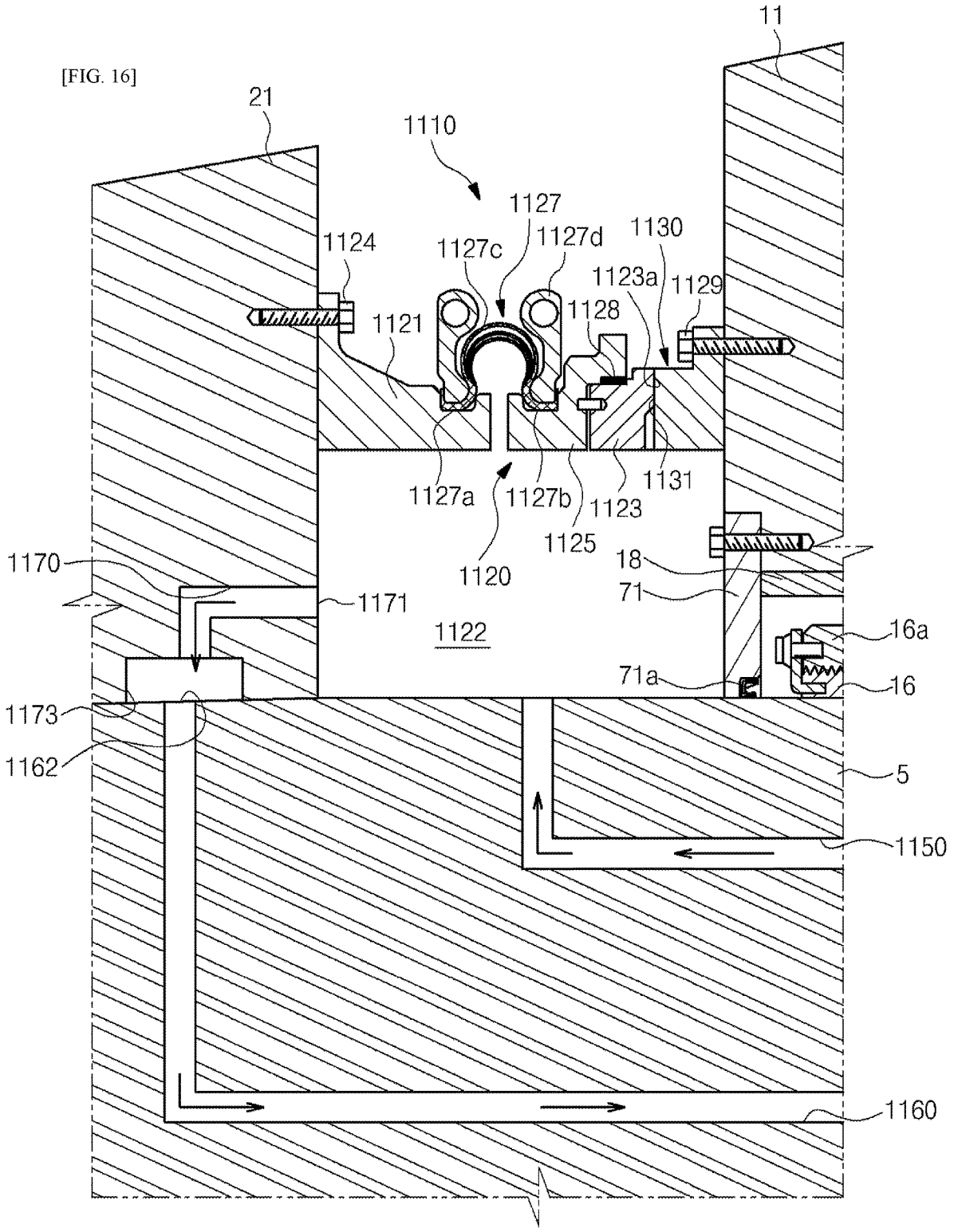

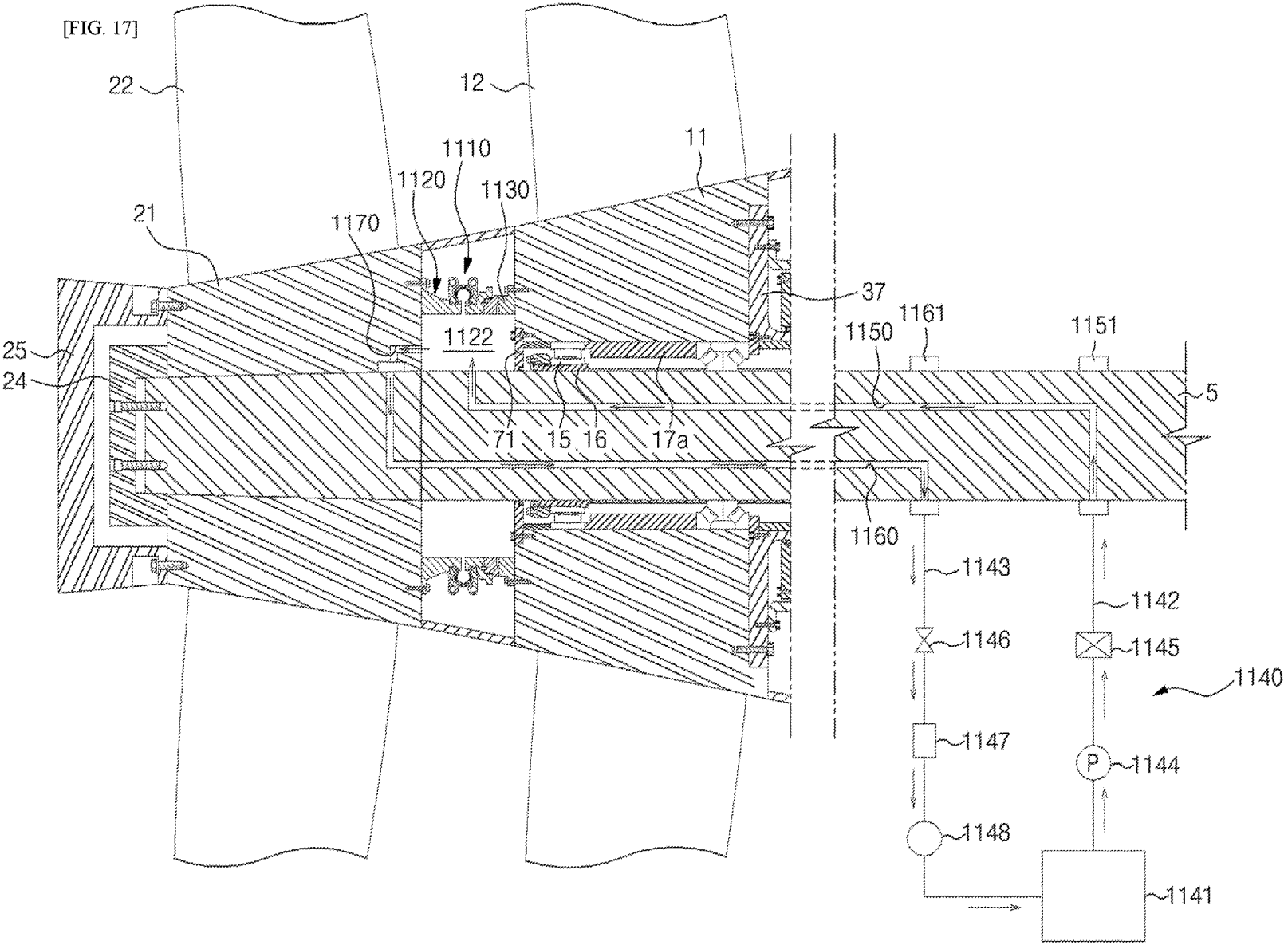
[FIG. 17]

[FIG. 18]
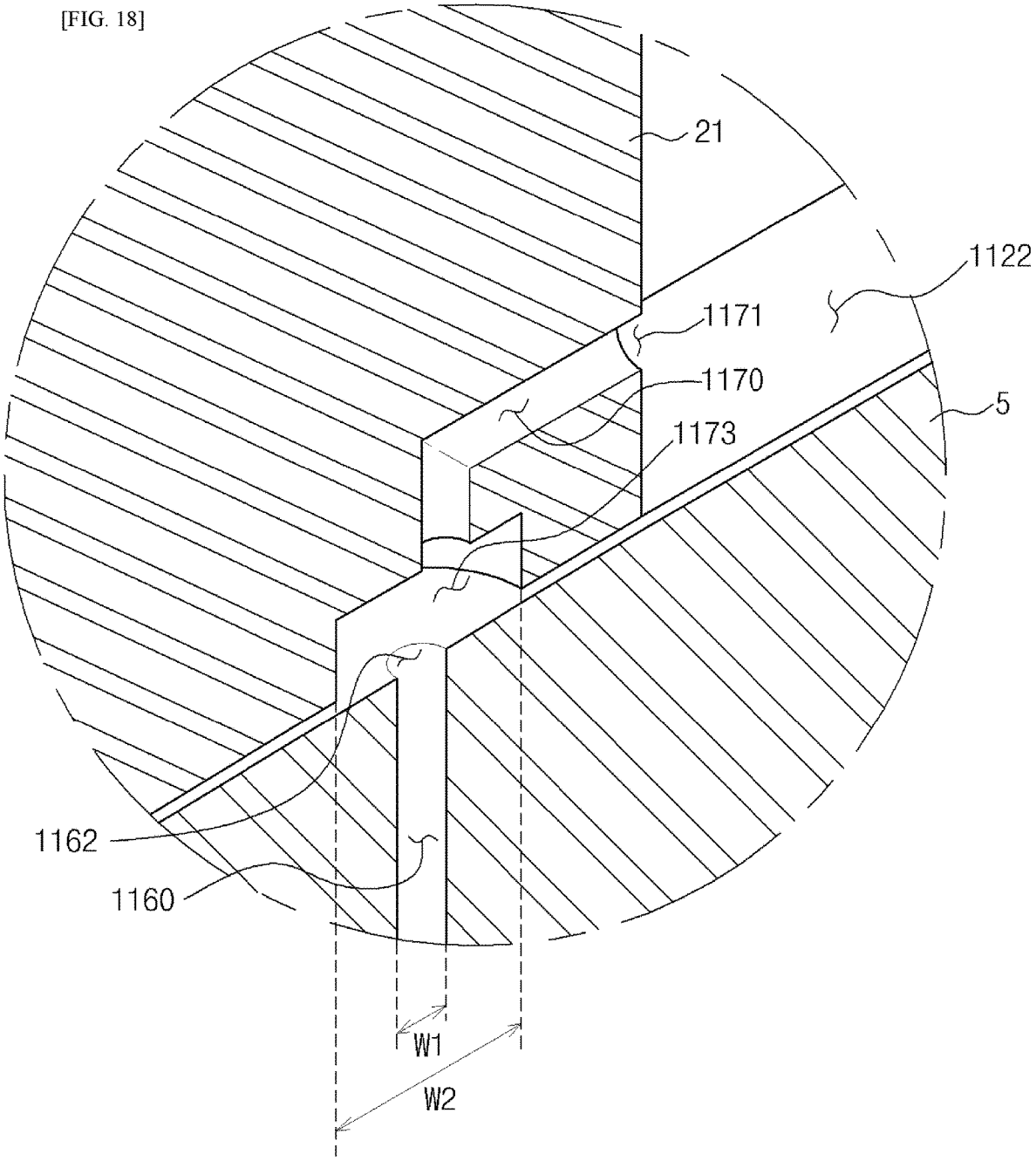

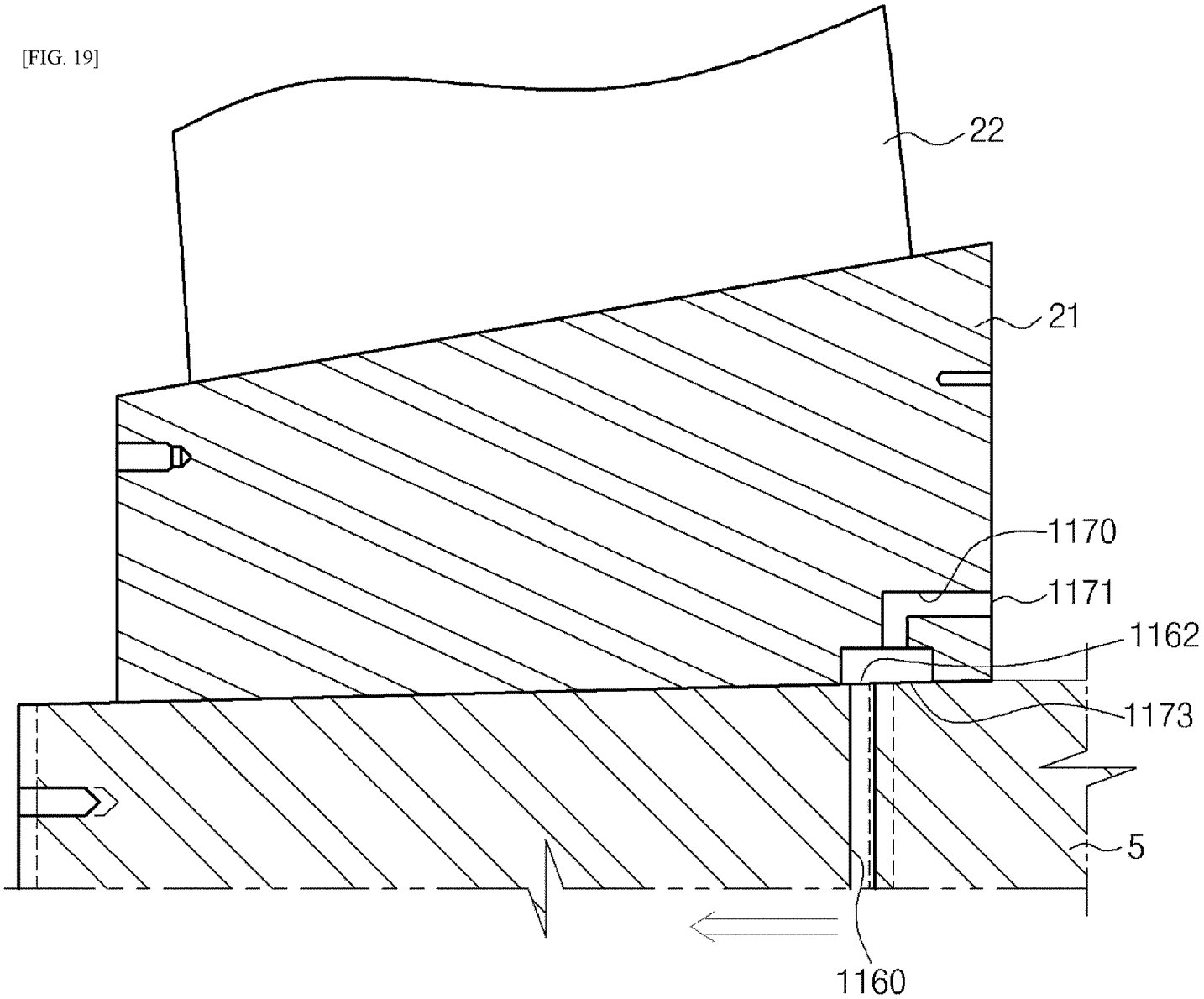
[FIG. 19]

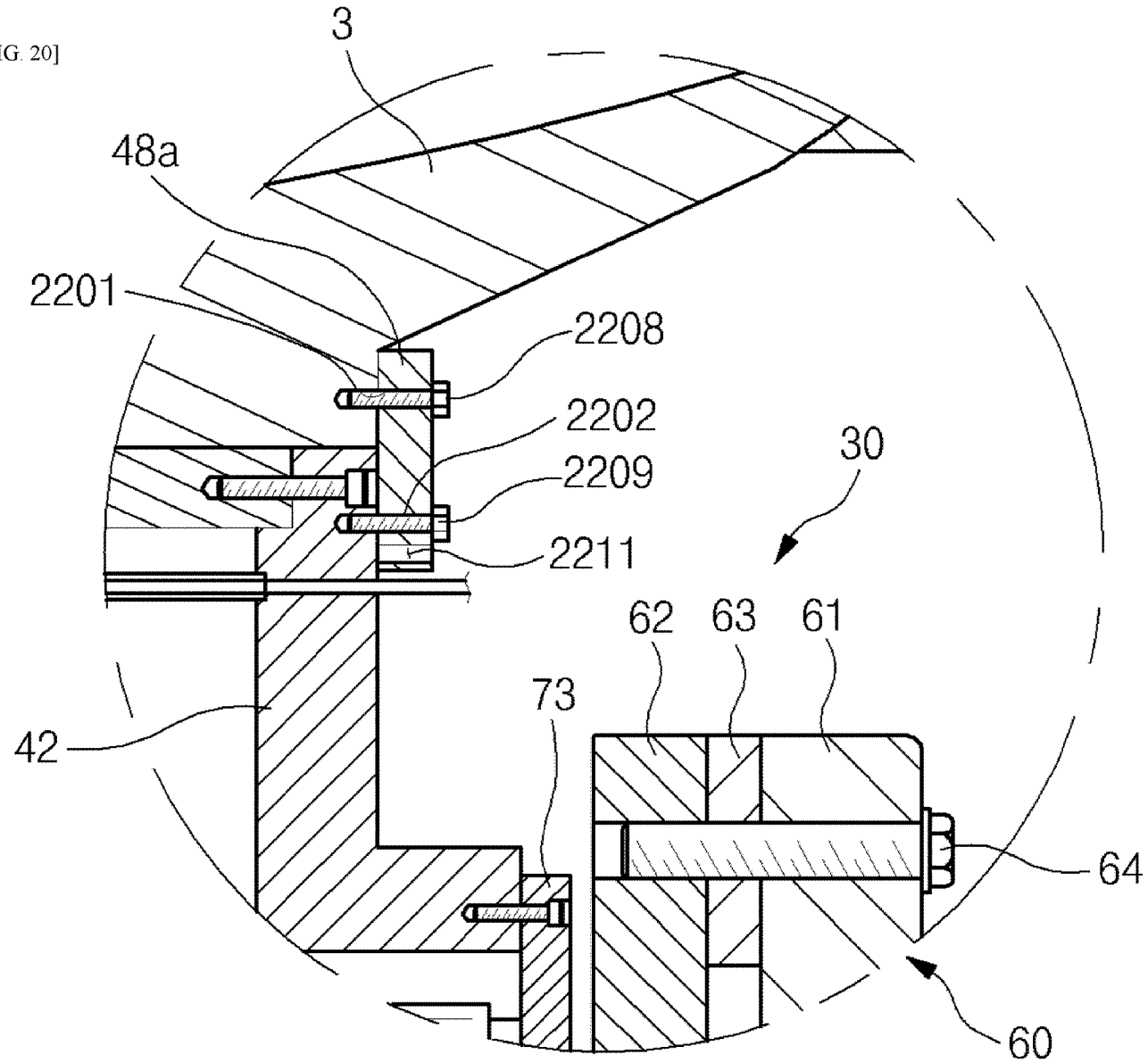
[FIG. 20]

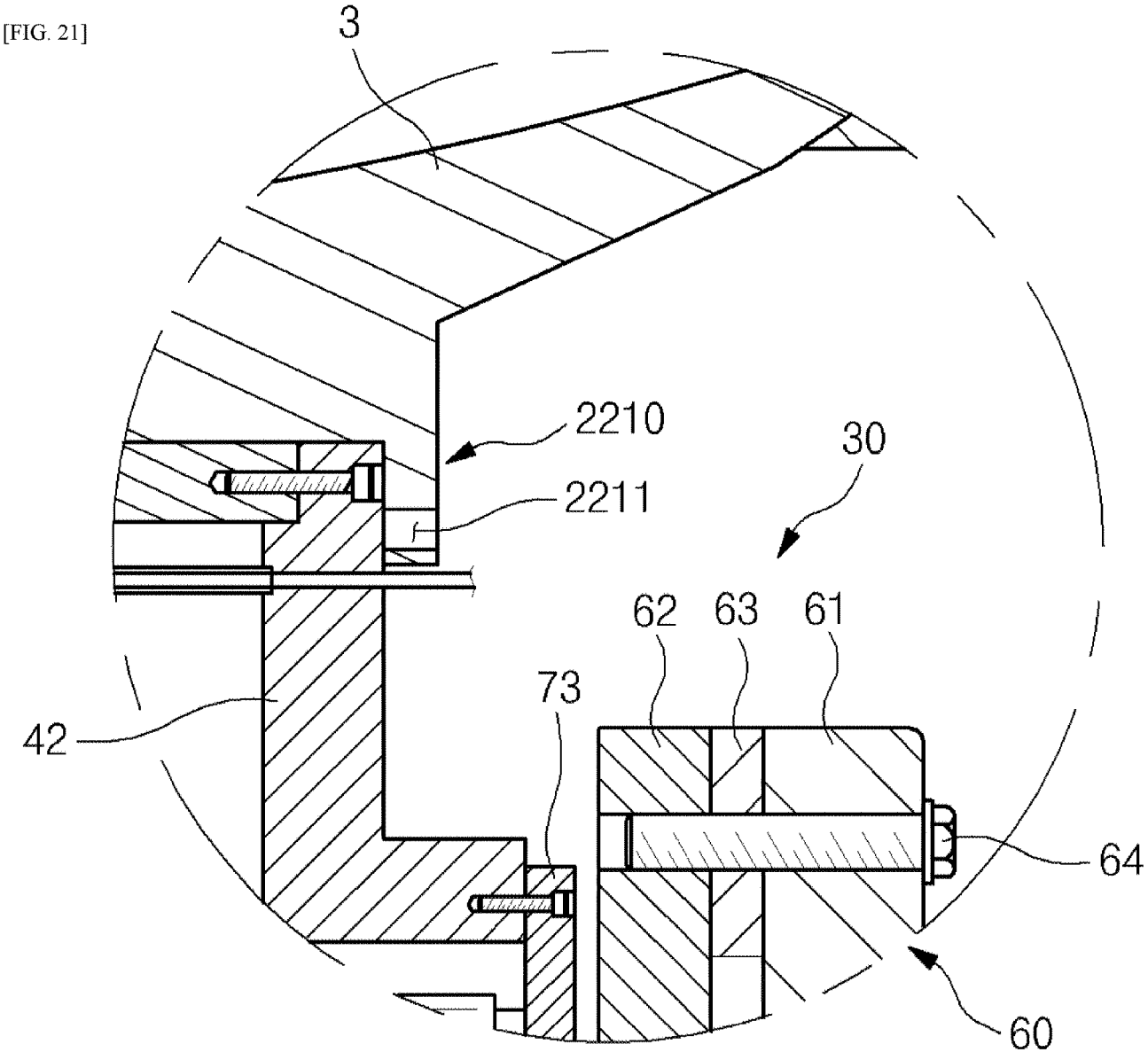
[FIG. 21]

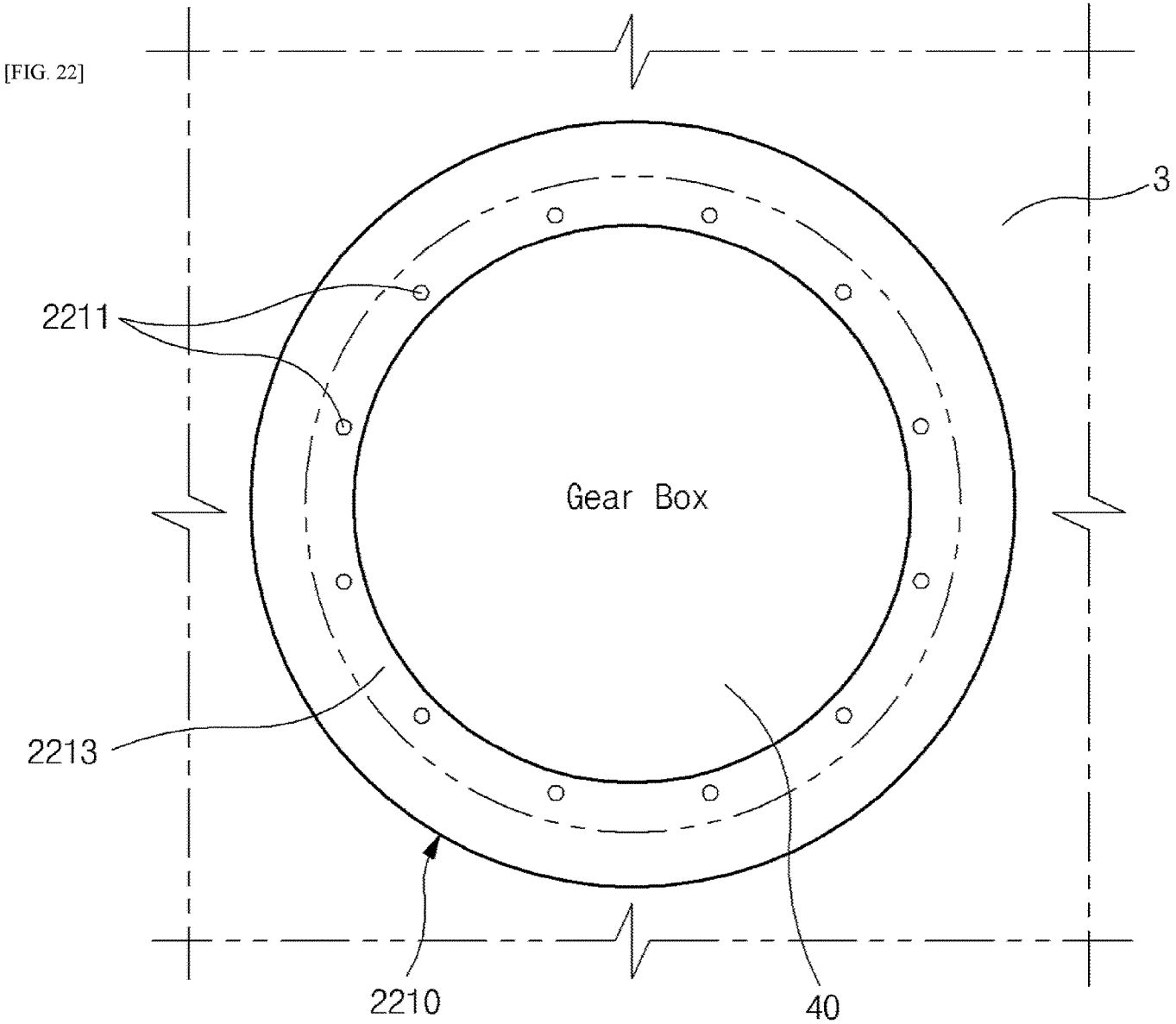
[FIG. 22]

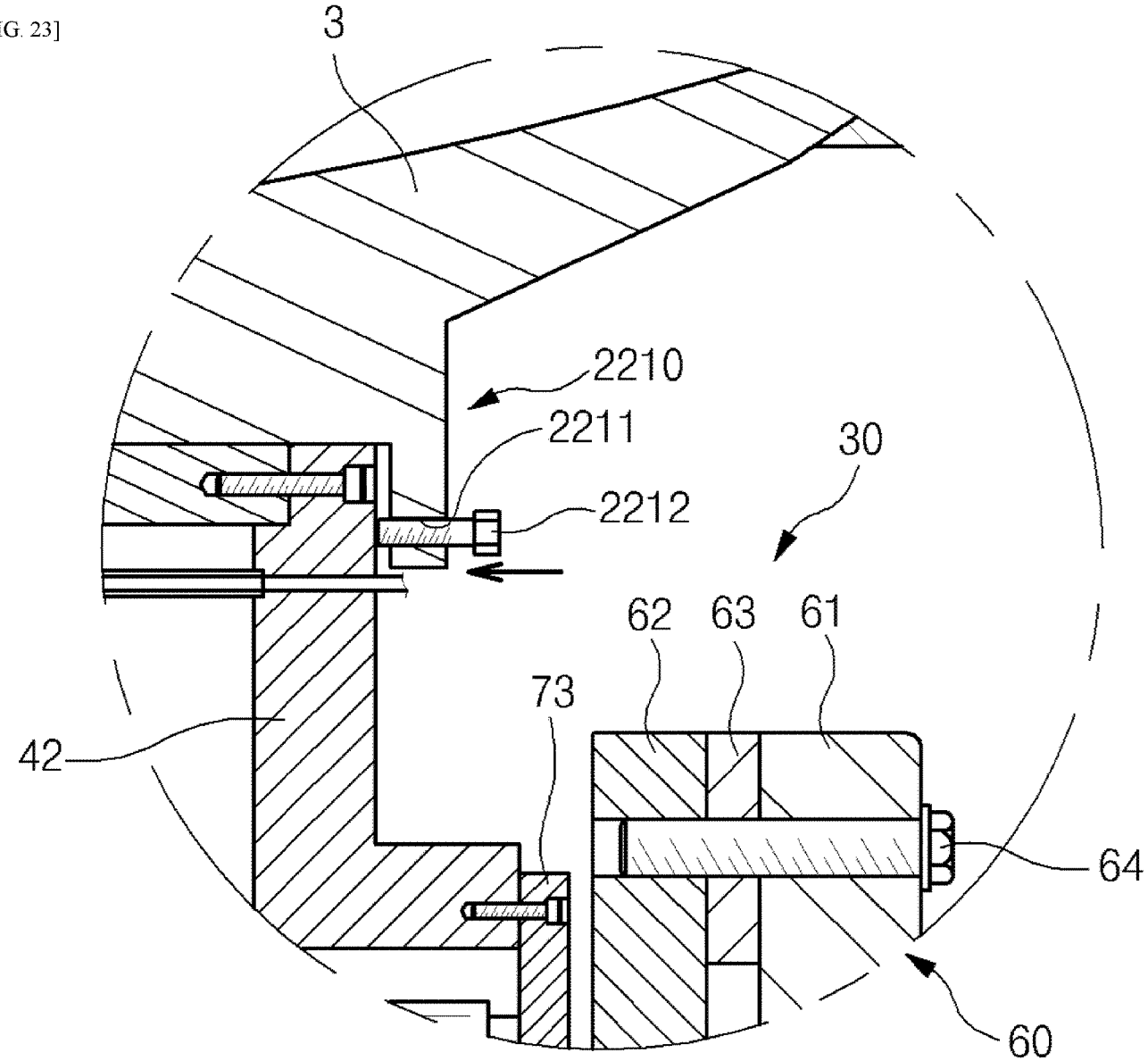
[FIG. 23]

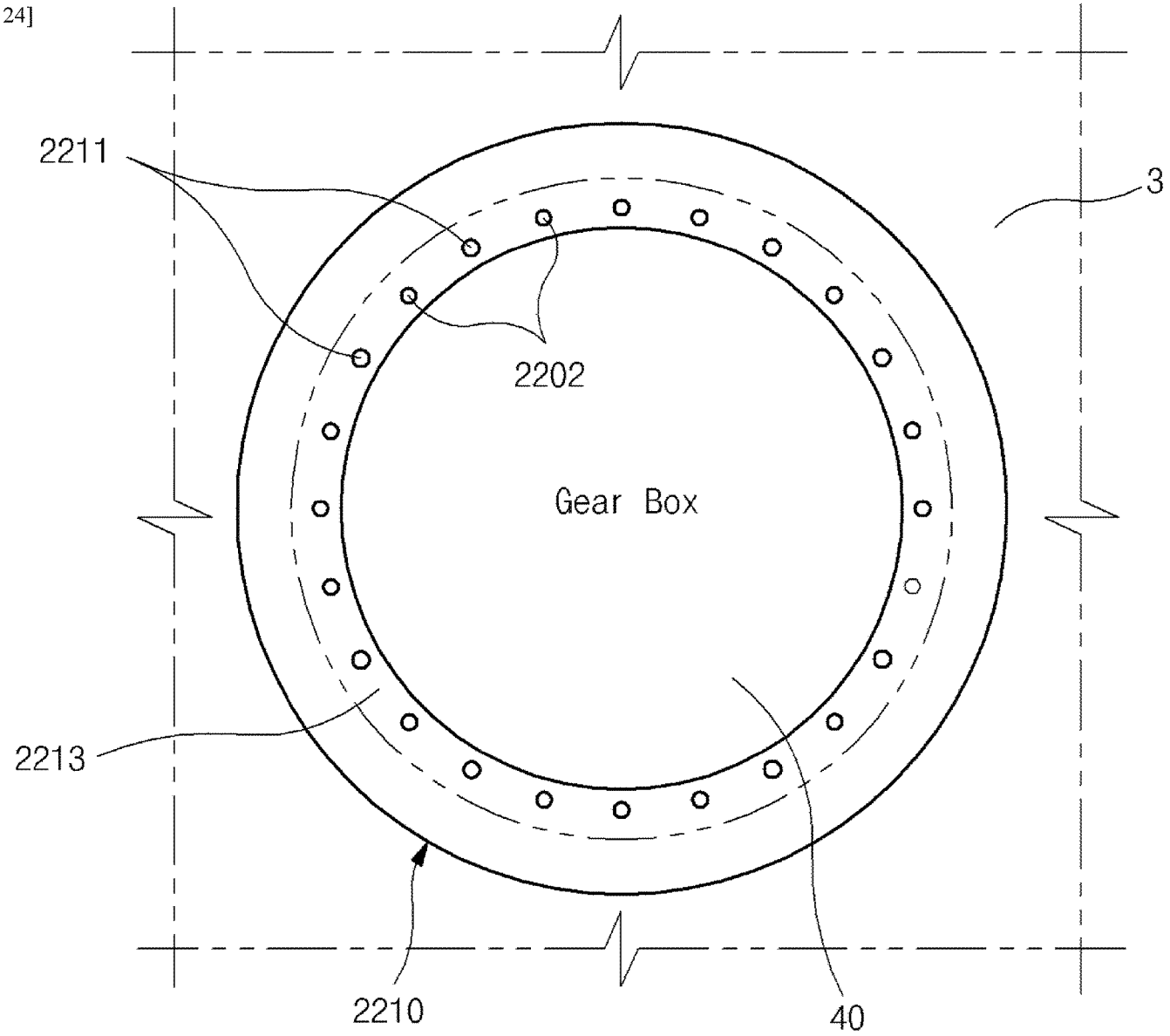
[FIG. 24]

[FIG. 25]
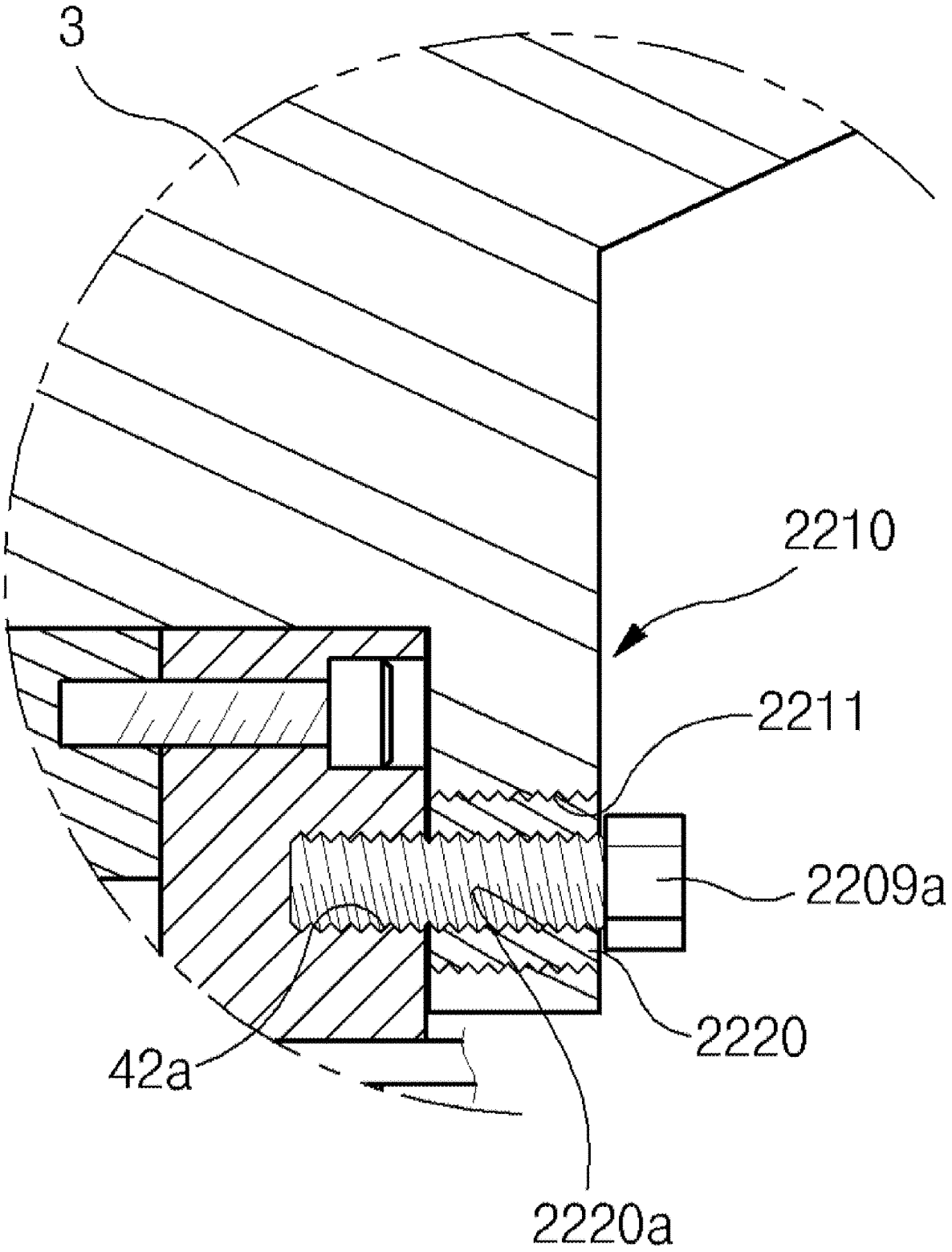

[FIG. 26]
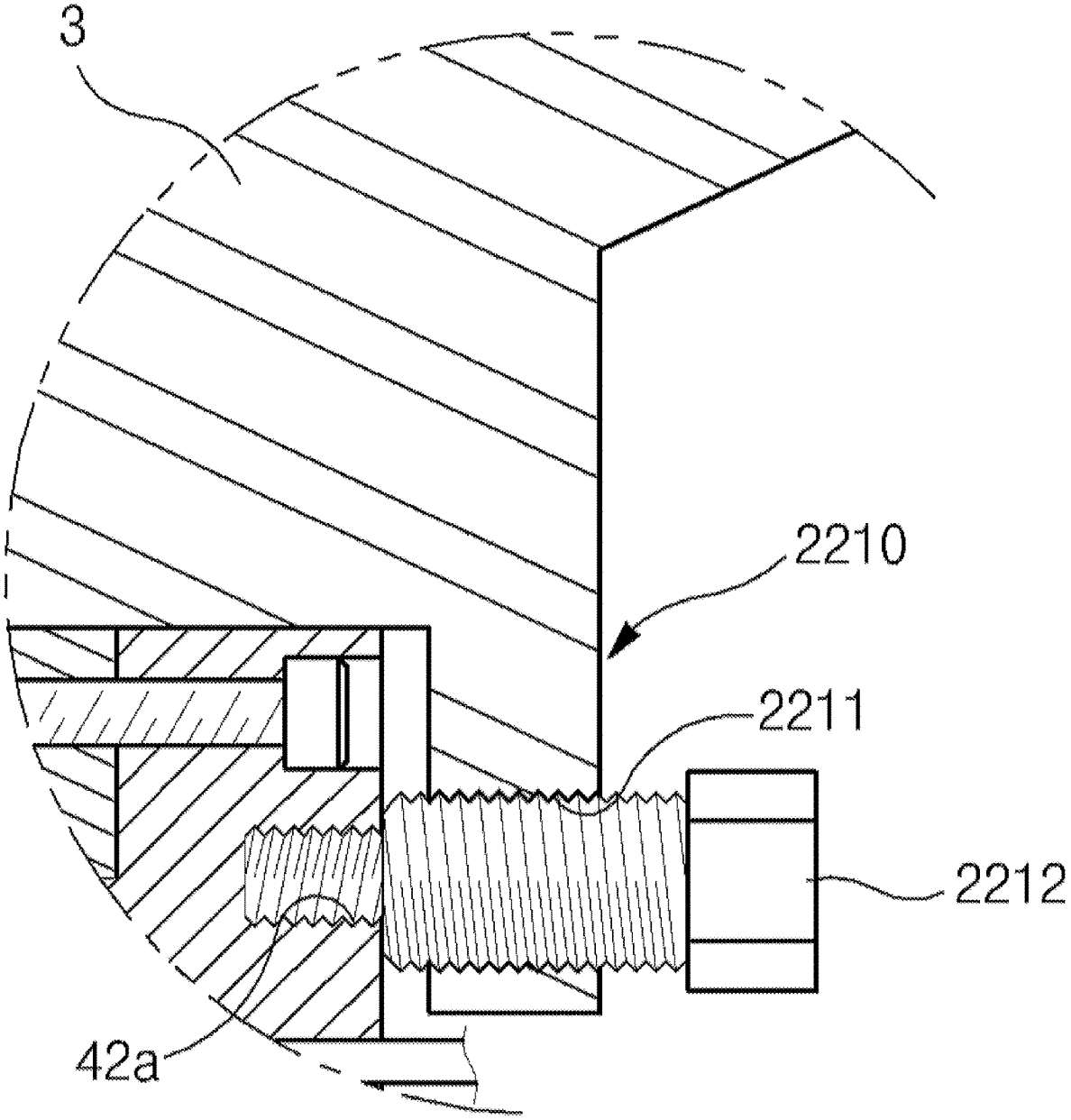

PROPULSION APPARATUS FOR SHIP

CROSS-REFERENCE TO RELATED APPLICATIONS

This application is a continuation of U.S. patent application Ser. No. 14/398,726, filed on Nov. 3, 2014, which is the U.S. National Stage of International Patent Application No. PCT/KR2013/003886 filed on May 6, 2013, which claims priority to Korean Patent Application No. 10-2012-0047373 filed in the Korean Intellectual Property Office on May 4, 2012, Korean Patent Application No. 10-2012-0049371 filed in the Korean Intellectual Property Office on May 9, 2012 and Korean Patent Application No. 10-2012-0049362 filed in the Korean Intellectual Property Office on May 9, 2012, the entire contents of which are incorporated herein by reference.

TECHNICAL FIELD

The present invention relates to a ship propelling apparatus in which two propellers rotate in opposite directions to generate a propulsive force, and a ship including the same.

BACKGROUND ART

In general, a ship propelling apparatus includes one spiral propeller. However, in the case of a propelling apparatus including one propeller, the rotational energy of water streams generated when the propeller rotates cannot be used as a propulsive force, thereby causing a high energy loss.

A counter-rotating propeller (CRP) is capable of collecting rotational energy, which may be lost, as a propulsive force. In the CRP, a propulsive force is generated as two coaxial propellers rotate in opposite directions. The rotational energy of a fluid passing through a front propeller is collected as a propulsive force by a rear propeller as the rear propeller rotates reversely. Thus, the CRP exhibits a higher propelling performance than a propelling apparatus including one propeller.

However, since the CRP includes a counter-rotating device enabling two propellers to rotate in opposite directions, a hollow shaft, etc., the CRP is thus relatively difficult to manufacture, install, maintain, and repair.

US Patent Publication No. US2011/0033296 (publication date: Feb. 10, 2011) and Japanese Patent Application Publication No. sho 62-279189 (publication date: Dec. 4, 1987) have disclosed examples of the CRP described above. US Patent Publication No. US2011/0033296 has disclosed a CRP including a planetary gear type counter-rotating device and a hollow shaft installed in a hull of a ship. Japanese Patent Application Publication No. sho 62-279189 has disclosed a double counter-rotating apparatus which is a planetary gear type counter-rotating apparatus installed in the tail of a ship.

DISCLOSURE

Technical Problem

One or more embodiments of the present invention provide a ship propelling apparatus that includes a simpler drivetrain system than in the related art, guarantees stable counter-rotations of two propellers, and is easy to manufacture, install, maintain, and repair, and a ship including the same.

One or more embodiments of the present invention also provide a ship propelling apparatus including a sealing device for securing the reliability of sealing performance between a front propeller and a rear propeller that rotate in counter-directions, and a ship including the same.

One or more embodiments of the present invention also provide a ship propelling apparatus in which a bolt is inserted into a separation groove of a front fixing member installed in the front of a gear box so that the gear box may be efficiently separated from an installation space in a tail of a ship due to a force applied to the gear box when the bolt is moved forward, and a ship including the same.

Technical Solution

One aspect of the present invention provides a ship propelling apparatus including a rotation shaft on which a rear propeller is fixed; a front propeller rotatably supported on the rotation shaft in front of the rear propeller; and a counter-rotating device through which the rotation shaft passes, which includes a gear box including therein a plurality of gears configured to reverse rotation of the rotation shaft and transfer the reversed rotation to the front propeller, and which is installed in an installation space formed at the rear of a ship. The rotation shaft includes a measurement hole formed to pass through a center of the rotation shaft for centering of the counter-rotating device installed in the installation space; and an individual lubricant path separated from the measurement hole.

Also, the counter-rotating device may include a first connector coupled to a drive flange provided on the rotation shaft so as to transfer a rotational force of the rotation shaft to the plurality of gears, and a second connector coupled to a hub of the front propeller to transfer outputs of the plurality of gears to the front propeller. Also, the plurality of gears may include a drive bevel gear coupled to the first connector; a driven bevel gear supported rotatably around the rotation shaft and coupled to the second connector; and at least one reverse bevel gear configured to reverse rotation of the drive bevel gear and transfer the reversed rotation to the driven bevel gear.

Another aspect of the present invention provides a ship propelling apparatus including a rear propeller fixed on a rotation shaft; a front propeller supported rotatably on the rotation shaft in front of the rear propeller; and a counter-rotating device configured to reverse rotation of the rotation shaft and transfer the reversed rotation to the front propeller. The counter-rotating device may include a gear box including therein a plurality of gears for reversing rotation of the front propeller and accommodated in an installation space formed in a tail of a ship, and a fixing flange provided at the front of the gear box, and including a separation groove which is a through-groove, wherein the gear box is separated from the installation space by applying a force to the gear box by inserting a bolt into the separation groove.

Also, a plurality of separation grooves may be formed along a marginal portion of the fixing flange that is in close contact with the gear box.

The ship propelling apparatus may further include a coupling member which is coupled to the separation groove and into which a clamp bolt is inserted to fix the front of the gear box on the tail of the ship.

Also, the gear box may be separated from the installation space due to a force applied to the gear box by the bolt inserted into the separation groove in a state in which the clamp bolt and the coupling member are loosened from the separation groove.

Also, a marginal portion of the fixing flange that is in close contact with the gear box may include clamp grooves into which clamp bolts are inserted to fix a front cover on the tail of the ship; and separation grooves formed alternately with the clamp grooves.

Also, the gear box may be separated from the installation space due to a force applied to the front cover by the bolts inserted into the separation grooves in a state in which the clamp bolts are loosened from the clamp grooves.

Also, the fixing flange may be coupled to the tail of the ship or formed integrally with the tail of the ship.

Still another aspect of the present invention provides a ship propelling apparatus including a rear propeller fixed on a rotation shaft; a front propeller supported rotatably on the rotation shaft in front of the rear propeller; a counter-rotating device including a plurality of gears for revering rotation of the rotation shaft and transferring the reversed rotation to the front propeller, and accommodated in an installation space formed in a tail of a ship; and a sealing device configured to seal between a hub of the front propeller and a hub of the rear propeller. The sealing device may include a pressurizing ring member coupled to one of the hubs and configured to apply a pressurizing force to the other hub; and a support ring member coupled to the other hub, and configured to be in surface contact with the pressurizing ring member in a sliding manner.

Also, the pressurizing ring member may include a fixing ring coupled to one of the hubs; a moving ring disposed apart from the fixing ring, and including a pressurizing unit that is in surface contact with the support ring member; and an elastic unit coupled between the fixing ring and the moving ring, and configured to apply a pressurizing force to pressurize the moving ring toward the support ring member.

Also, the pressurizing unit may be coupled to the moving ring to be detachable from the moving ring.

Also, a sliding surface of the pressurizing unit that is in surface contact with the support ring member may be perpendicular to the rotation shaft.

Also, the elastic unit may include a pair of fixing units, both ends of which are coupled to outer surfaces of the fixing ring and the moving ring; and a circular arc unit configured to connect the pair of fixing units to apply the pressurizing force.

The ship propelling apparatus may further include a sealing unit configured to seal between the moving ring and the pressurizing unit.

Advantageous Effects

A propelling apparatus according to an exemplary embodiment of the present invention is easy to manufacture and install, since centering of a counter-rotating device can be performed via a measurement hole formed in a rotation shaft after a gear box of the counter-rotating device is loaded into an installation space formed in a tail of a ship in a state in which the counter-rotating device is manufactured and assembled outside the ship.

Also, a propelling apparatus according to an exemplary embodiment of the present invention is easy to maintain and repair since a gear box of a counter-rotating device can be separated from a ship when the gear box is out of order.

Also, a propelling apparatus according to an exemplary embodiment of the present invention causes a front propeller to reversely rotate using a plurality of bevel gears and thus may have a smaller volume and a simpler drivetrain system than a general planetary gear type counter-rotating device.

Also, since the volume of the counter-rotating device is small, the counter-rotating device can be installed in a tail a ship.

Also, in a propelling apparatus according to an exemplary embodiment of the present invention, a counter-rotating device may be installed in a tail of a ship and thus a hollow shaft employed in the related art may be omitted. Thus, the structure of a drivetrain system may be simpler than in the related art, the size of an area that needs to be lubricated may be reduced, and various problems that may occur due to lubrication may be minimized.

Also, in a propelling apparatus according to an exemplary embodiment of the present invention, a sealing device may allow radial displacement of a front propeller or a rear propeller due to a non-uniform load applied thereto, thereby enhancing the sealing performance thereof.

Also, a bolt may be inserted into a separation groove formed in a front fixing member installed in the front of a gear box so that the gear box may be efficiently separated from an installation space in a tail of a ship due to a force applied to the gear box when the bolt is moved forward.

DESCRIPTION OF DRAWINGS

FIG. 1 is a cross-sectional view of a state in which a propelling apparatus is applied to a ship according to an exemplary embodiment of the present invention.

FIG. 2 is a cross-sectional view of a propelling apparatus according to an exemplary embodiment of the present invention.

FIG. 3 is an exploded perspective view of a propelling apparatus according to an exemplary embodiment of the present invention.

FIG. 4 is an exploded perspective view of a counter-rotating device of a propelling apparatus according to an exemplary embodiment of the present invention.

FIG. 5 is a detailed cross-sectional view of a structure in which bearings are mounted to support a front propeller of a propelling apparatus according to an exemplary embodiment of the present invention.

FIG. 6 is a detailed cross-sectional view of a structure in which bearings are mounted to support a front propeller of a propelling apparatus according to another exemplary embodiment of the present invention, in which a first radial bearing is loosened.

FIG. 7 is a cross-sectional view of a counter-rotating device of a propelling apparatus according to an exemplary embodiment of the present invention, in which a counter-rotating device is separated.

FIG. 8 is a cross-sectional view of a method of aligning a center of a rotation shaft assembled in a gear box included in the counter-rotating device of FIG. 7 and a center of a main drive shaft coupled to a drive source using a shaft alignment tester.

FIG. 9 illustrates the shaft alignment tester of the FIG. 8.

FIG. 10 illustrates a state in which an optical sensor unit included in the shaft alignment tester of FIG. 9 is installed and a rear end of a rotation shaft is closed by a sealing cap.

FIG. 11 is a cross-sectional view of a state in which a counter-rotating device of a propelling apparatus is mounted in an installation space formed in a tail of a ship according to an exemplary embodiment of the present invention.

FIG. 12 is a cross-sectional view of a first sealing device of a propelling apparatus according to an exemplary embodiment of the present invention.

FIG. 13 is an exploded perspective view of a first sealing device of a propelling apparatus according to an exemplary embodiment of the present invention.

FIG. 14 is a cross-sectional view of a second sealing device of a propelling apparatus according to an exemplary embodiment of the present invention.

FIG. 15 is a cross-sectional view of a propelling apparatus according to another exemplary embodiment of the present invention.

FIG. 16 is a cross-sectional view of a sealing device installed between the front of a propelling apparatus and a rear propeller according to another exemplary embodiment of the present invention.

FIG. 17 illustrates a structure for supplying a lubricant to a sealing device installed between the front of a propelling apparatus and a rear propeller according to another exemplary embodiment of the present invention.

FIG. 18 illustrates a structure of a connecting fluid path formed in a hub of a rear propeller of a propelling apparatus according to another exemplary embodiment of the present invention.

FIG. 19 is a diagram illustrating a change in the location of a fluid path caused by a change in the length of a main shaft according to another exemplary embodiment of the present invention.

FIG. 20 is a cross-sectional view of a separation groove formed in a front fixing member provided in front of a gear box included in the counter-rotating device of FIG. 8.

FIG. 21 is a cross-sectional view of a fixing flange in which the front fixing member of FIG. 20 is provided.

FIG. 22 is a cross-sectional view of a separation groove formed in the fixing flange of FIG. 21.

FIG. 23 is a cross-sectional view of a state in which a gear box is separated from an installation space formed in a tail of a ship using a jack bolt inserted into the separation groove in the fixing flange of FIG. 22.

FIG. 24 is a cross-sectional view of another example of the fixing flange of FIG. 22.

FIG. 25 is a cross-sectional view of another example of the fixing flange of FIG. 21 in which a coupling member is coupled to a separation groove which also serves as a clamp groove.

FIG. 26 is a cross-sectional view of a state in which a gear box is separated from an installation space formed in the tail of a ship by a jack bolt inserted into the separation groove in the fixing flange of FIG. 25.

MODES OF THE INVENTION

Hereinafter, exemplary embodiments of the present invention will be described in detail with reference to the accompanying drawings.

As illustrated in FIGS. 1 and 2, a ship propelling apparatus according to an embodiment of the present invention includes a front propeller 10 and a rear propeller 20 disposed at the rear of a ship 1 such that shaft lines thereof coincide with each other, and a counter-rotating device 30 installed in a tail 3 of the ship 1 to cause the front propeller 10 and the rear propeller 20 to rotate in opposite directions. That is, the ship propelling apparatus is a double counter-rotating propelling apparatus in which the two propellers 10 and 20 rotate in opposite directions to generate a propulsive force.

Here, the tail 3 of the ship 1 means a streamlined portion (i.e., a stern boss) of the ship 1 protruding toward the rear thereof to install the front and rear propellers 10 and 20 and the counter-rotating device 30 therein. The tail 3 of the ship 1 may be manufactured by casting, and fixed on the ship 1 by welding. Also, the tail 3 of the ship 1 includes an installation space 4 having pass-through front and rear portions to accommodate a gear box 40 of the counter-rotating device 30 which will be described below. Inner surfaces of the installation space 4 may be processed in a cylindrical shape by boring to correspond to the shape of the gear box 40.

As illustrated in FIGS. 2 and 3, the counter-rotating device 30 includes the gear box 40 accommodated in the installation space 4 of the tail 3 of the ship 1, and a rotation shaft 5 supported rotatably on the gear box 40 while passing through a roughly central portion of the gear box 40.

As illustrated in FIGS. 2 to 4, the counter-rotating device 30 may include a drive bevel gear 31 installed in the gear box 40 to rotate together with the rotation shaft 5, a driven bevel gear 32 disposed opposite the drive bevel gear 31 to be supported rotatably on the rotation shaft 5 in the gear box 40, and a plurality of reverse bevel gears 33 configured to reverse rotation of the drive bevel gear 31 and transfer the reversed rotation to the driven bevel gear 32. The counter-rotating device 30 may further include a cylindrical first connector 35 for connecting the rotation shaft 5 and the drive bevel gear 31, and a cylindrical second connector 36 for connecting the driven bevel gear 32 and a hub 11 of the front propeller 10.

A front end of the rotation shaft 5 protruding toward the front of the gear box 40 may be connected to a main drive shaft 6 in the ship 1 such that the front end thereof can be combined with/separated from the main drive shaft 6. The main drive shaft 6 may be connected to a drive source 8 (a diesel engine, a motor, a turbine, etc.) installed in the ship 1 to cause the rotation shaft 5 to rotate together with the main drive shaft 6 as illustrated in FIG. 1.

The rear propeller 20 is fixed on the rotation shaft 5 extending to the rear of the gear box 40, and the front propeller 10 is rotatably supported on an outer interface between the rear propeller 20 and the gear box 40. As will be described in detail below, the front propeller 10 may be connected to the counter-rotating device 30 so that the front propeller 10 may rotate in a direction opposite to the rotational direction of the rear propeller 20 when the rotation shaft 5 rotates.

The main drive shaft 6 and the rotation shaft 5 may be coupled using a cylindrical coupling device 7 by spline shaft coupling such that they can be combined with each other or separated from each other. Here, the spline shaft coupling is provided as an example but a method of connecting the main drive shaft 6 and the rotation shaft 5 is not limited thereto. Alternatively, flange coupling, a friction clutch method, a magnetic clutch method, etc. may be selectively employed.

The rear propeller 20 is fixed on a tail portion of the rotation shaft 5 to rotate together with the rotation shaft 5 as illustrated in FIGS. 2 and 3. The rear propeller 20 includes a hub 21 fixed on the rotation shaft 5, and a plurality of wings 22 provided on an outer surface of the hub 21. The hub 21 of the rear propeller 20 may be fixed on the rotation shaft 5 by press-fitting a shaft coupling hole 23 in a center thereof to an outer surface of the rotation shaft 5. A fixing cap 24 is clamped to a rear end of the rotation shaft 5 to firmly fix the rear propeller 20 on the rotation shaft 5.

For the coupling, a tail portion 5*a* of the rotation shaft 5 may be provided in the form of a tapered outer surface, the external diameter of which tapers toward the rear thereof, and the shaft coupling hole 23 of the hub 21 may be provided in the form of a tapered inner surface corresponding to the outer surface of the rotation shaft 5. In FIG. 2, reference numeral '25' denotes a propeller cap installed on the hub 21 to cover a rear end of the hub 21 of the rear propeller 20 and the fixing cap 24.

The front propeller 10 is installed rotatably on an outer surface of the rotation shaft 5 between the rear propeller 20 and the counter-rotating device 30. The front propeller 10 includes the hub 11 supported rotatably on the outer surface of the rotation shaft 5, and a plurality of wings 12 provided on an outer surface of the hub 11. The front propeller 10 may be installed on an outer surface of the rotation shaft 5 before the rear propeller 20 is installed. Also, since the front propeller 10 rotates in a direction opposite to the rotational direction of the rear propeller 20, a wing angle of the front propeller 10 is different from that of the rear propeller 20.

The hub 11 of the front propeller 10 may be supported rotatably on an outer surface of the rotation shaft 5 by a first thrust bearing 13, a second thrust bearing 14, and a first radial bearing 15 as illustrated in FIGS. 2 and 5. The first thrust bearing 13 and the second thrust bearing 14 may be installed between a front inner side of the hub 11 and the outer surface of the rotation shaft 5. The first radial bearing 15 may be installed between a rear inner surface of the hub 11 and the outer surface of the rotation shaft 5.

The first radial bearing 15 may withstand a radial load applied by the front propeller 10 in a radial direction of the rotation shaft 5, and the first and second thrust bearings 13 and 14 may withstand thrust loads applied in front of and at the rear of the rotation shaft 5. In detail, the second thrust bearing 14 may withstand a thrust load applied from the front propeller 10 to a bow of the ship 1 when the ship 1 moves forward, and the first thrust bearing 13 may withstand a thrust load applied from the front propeller 10 toward the stern of the ship 1 when the ship 1 moves backward.

As illustrated in FIG. 5, an inner ring of the first thrust bearing 13 and an inner ring of the second thrust bearing 14 are disposed in contact with each other in a state in which they are press-fitted at an outer surface of the rotation shaft 5, and may be thus supported not to be pushed out in an axial direction. An outer ring of the first thrust bearing 13 is supported by a fixing ring 39 installed in the second connector 36 combined with the hub 11 not to be pushed out in the axial direction.

A first cylindrical support ring 17*a* and a second cylindrical support ring 17*b* are installed between the hub 11 of the front propeller 10 and the rotation shaft 5 not to push out the second thrust bearing 14 in the axial direction. The first support ring 17*a* may be disposed between an outer ring of the second thrust bearing 14 and an outer ring of the first radial bearing 15 to support the second thrust bearing 14 and the first radial bearing 15. The second support ring 17*b* may be disposed between an inner ring of the second thrust bearing 14 and an inner ring of the first radial bearing 15 to support the second thrust bearing 14 and the first radial bearing 15. Also, a distance adjustment ring 18 may be installed on an inner surface of the hub 11 between the outer ring of the first radial bearing 15 and a first sealing cover 71 which will be described below not to cause the outer ring of the first radial bearing 15 to be pushed out in the axial direction. Here, in order to more stably support the outer ring of the first radial bearing 15, a case in which the distance adjustment ring 18 is installed is provided, but if the outer ring of the first radial bearing 15 is press-fitted on an internal surface of the hub 11, the outer ring of the first radial bearing 15 may be fixed even when the distance adjustment ring 18 is not installed. Thus, the distance adjustment ring 18 may be selectively employed according to design.

As illustrated in FIG. 5, a cylindrical wedge member 16 may be installed between the inner ring of the first radial bearing 15 and an outer surface of the rotation shaft 5 so that the inner ring of the first radial bearing 15 may not be pushed out in the axial direction. The wedge member 16 includes a tapered outer surface, the external diameter of which tapers toward the rear of the wedge member 16, and a screw thread formed on an outer surface of the rear of the wedge member 16. An inner surface of the wedge member 16 may be press-fitted and fixed to an outer surface of the rotation shaft 5. The movement of the inner ring of the first radial bearing 15 may be constrained by inserting a lock nut 16*a* into the screw thread in the rear of the wedge member 16. Thus, the first radial bearing 15 may be firmly fixed between an outer surface of the rotation shaft 5 and an inner surface of the hub 11. A fixing clip 16*b* may be inserted into the wedge member 16 and the lock nut 16*a* to prevent the wedge member 16 and the lock nut 16*a* from being loosened.

When the front propeller 10 is installed, first, the first thrust bearing 13, the second thrust bearing 14, the first and second support rings 17*a* and 17*b*, and the wedge member 16 may be sequentially installed on an outer surface of the rotation shaft 5. Then, as illustrated in FIG. 6, an outer side of the rotation shaft 5 is coupled to the hub 11 of the front propeller 10 to couple an inner surface of the hub 11 to the outer rings of the first and second thrust bearings 13 and 14. Then, the first radial bearing 15 is installed by being pushed between an outer surface of the wedge member 16 and an inner surface of the hub 11, and then the lock nut 16*a* may be inserted into the wedge member 16 to fix the inner ring of the first radial bearing 15. After the first radial bearing 15 is installed, the distance adjustment ring 18 may be installed and the first sealing cover 71 may be mounted.

When the first radial bearing 15 is fixed using the wedge member 16 as described above, even if an error occurs during manufacture of components, such as the first and second support rings 17*a* and 17*b*, etc. and an installation location of the first radial bearing 15 is changed, a coupling error may be compensated by adjusting mounting locations of the wedge member 16 and the first radial bearing 15. That is, the first radial bearing 15 may be fixed in a state in which the wedge member 16 and the first radial bearing 15 are pressed toward the first and second support rings 17*a* and 17*b*, thereby minimizing a coupling error between components. The distance between the outer ring of the first radial bearing 15 and the first sealing cover 71 may be measured and the distance adjustment ring 18 may be manufactured and installed based on the measured distance, in a state in which the first radial bearing 15 is mounted.

When the front propeller 10 is separated from the rotation shaft 5 to be repaired in the future, the first sealing cover 71 and the distance adjustment ring 18 are separated from each other, the lock nut 16*a* is loosened from the wedge member 16 to separate the first radial bearing 15, and then the front propeller 10 is pulled to be separated from the rotation shaft 5 in a rear direction. After the front propeller 10 is separated, the first and second thrust bearings 13 and 14, the wedge member 16, are the first and second support rings 17*a* and 17*b* are exposed and thus may be also easily separated from the rotation shaft 5.

As illustrated in FIGS. 2 and 4, the gear box 40 of the counter-rotating device 30 may include a body unit 41 having a cylindrical shape, configured to accommodate therein the drive bevel gear 31, the driven bevel gear 32, and the plurality of reverse bevel gears 33, and both ends of which are open; a front cover 42 coupled to the body unit 41 to close a front opening of the body unit 41; and a rear cover 43 coupled to the body unit 41 to close a rear opening of the body unit.

The front cover 42 may rotatably support the first connector 35 passing through a central portion thereof. The rear cover 43 may also rotatably support the second connector 36 passing through a central portion thereof. To this end, a front bearing 44 may be installed between an outer surface of the first connector 35 and the front cover 42, and a rear outer bearing 45 may be installed between an outer surface of the second connector 36 and the rear cover 43.

A plurality of rear outer bearings 45 may be continuously installed in a direction of the length of the rotation shaft 5 to cause the second connector 36 to rotate while the second connector 36 are stably supported. A rear inner bearing 46 may be installed between an inner surface of the second connector 36 and the rotation shaft 5 to rotatably support the second connector 36, and a cylindrical sleeve bearing 47 may be installed between the first connector 35 and an outer surface of the rotation shaft 5. Also, a cylindrical separation ring 49 may be installed on an outer surface of the rotation shaft 5 between an inner ring of the rear inner bearing 46 and the sleeve bearing 47 to support between the inner ring of the rear inner bearing 46 and the sleeve bearing 47.

All the front bearing 44, the rear outer bearing 45, and the rear inner bearing 46 may be radial bearings. The bearings 44, 45, and 46 may enable the rotation shaft 5, the first connector 35, and the second connector 36 to stably rotate while supporting radial load applied thereto.

The drive bevel gear 31 is coupled to the first connector 35 by clamping them with a plurality of clamp bolts 31*a* to rotate together with the first connector 35. The driven bevel gear 32 is also coupled to the second connector 36 by clamping them with a plurality of clamp bolts 32*a*. An internal diameter of the driven bevel gear 32 may be spaced apart from the rotation shaft 5 so that rotation of the driven bevel gear 32 may not be interfered by the rotation shaft 5.

The plurality of reverse bevel gears 33 are disposed between the drive bevel gear 31 and the driven bevel gear 32 while being engaged with the drive bevel gear 31 and the driven bevel gear 32. A shaft 34 supporting the reverse bevel gears 33 is disposed in a direction crossing the rotation shaft 5 (a direction of the radius of the rotation shaft 5), and the reverse bevel gears 33 may be disposed around the rotation shaft 5 in a radial form. Also, bearings 34*a* and 34*b* may be installed at both ends of the shaft 34 of the reverse bevel gears 33 to smoothly rotate the shaft 34.

An internal frame 50 may be installed in the gear box 40 to install the reverse bevel gears 33. The internal frame 50 may be fixed in the body unit 41 by clamping a plurality of fixing members 51 thereto while the internal frame 50 is present in the gear box 40.

As illustrated in FIG. 4, a through-hole 52 through which the rotation shaft 5 passes is formed at a center of the internal frame 50, and the internal frame 50 may be provided in a cylindrical or polygonal shape, the width W (in the direction of the length of the rotation shaft 5) of which is less than a maximum external diameter of the reverse bevel gears 33.

The internal frame 50 accommodates the reverse bevel gears 33 to be rotable, and includes a plurality of gear installation units 53, both sides of which are open to cause the reverse bevel gears 33 to be geared with the drive bevel gear 31 and the driven bevel gear 32. The internal frame 50 further includes first shaft supports 54 and second shaft supports 55 configured to support the bearings 34*a* and 34*b* installed at both ends of the shaft 34 of the reverse bevel gears 33, respectively. The components of the internal frame 50 may be disposed radially around the through-hole 52 so as to install the plurality of reverse bevel gears 33.

As illustrated in FIG. 4, the first shaft support 54 and the second shaft support 55 may be open in a direction of one side of the internal frame 50 so as to install the shaft 34 of the reverse bevel gears 33. Here, a first clamp member 54*a* and a second clamp member 55*a* may be mounted to fix the bearings 34*a* and 34*b* while covering the bearings 34*a* and 34*b*. Thus, when the reverse bevel gears 33 are installed in the internal frame 50, the reverse bevel gears 33, the shaft 34 of the reverse bevel gears 33, and the bearings 34*a* and 34*b* are assembled together, and the assembly is installed by loading it into the gear installation units 53 from a direction of one side surface of the internal frame 50 and fixed by clamping the first and second clamp members 54*a* and 55*a* thereto. The above method of installing the reverse bevel gears 33 into the internal frame 50 is just an example, and a method of installing the reverse bevel gear 33 is not limited thereto. When the internal frame 50 is formed in a different shape than that described above, a method of installing the reverse bevel gears 33 into the internal frame 50 may be changed.

The internal frame 50 into which the reverse bevel gears 33 are installed may be loaded into the body unit 41 of the gear box 40 and fixed in the body unit 41 by clamping the plurality of fixing members 51 thereto, before the drive bevel gear 31, the driven bevel gear 32, the front cover 42, and the rear cover 43 are installed during assembly of the counter-rotating device 30.

The plurality of fixing members 51 may be provided in the form of cylindrical pins as illustrated in FIGS. 4 and 7. The fixing member 51 is installed to be loaded into the body unit 41 while passing through the body unit 41 from an external side of the body unit 41. Thus, the internal frame 50 may be supported to be fixed by inner ends of the fixing member 51. The internal frame 50 may be bound by inserting the inner ends of the fixing member 51 into the fixing grooves 56 formed in the circumferential surface of the internal frame 50. Outer ends of the fixing member 51 may be fixed on the body unit 41 by clamping them with a clam screw.

In the gear box 40, a reverse bevel gear assembly including the internal frame 50 may be installed in the body unit 41, the drive bevel gear 31 and the driven bevel gear 32 may be installed via openings at both sides of the body unit 41, and then components such as the front cover 42, the rear cover 43, the first connector 35, and the second connector 36 may be installed. Thus, the counter-rotating device 30 is easy to assemble and repair.

In the present embodiment, the counter-rotating device 30 includes the plurality of reverse bevel gear 33 but may include one reverse bevel gear 33 provided that the reverse bevel gear 33 is capable of reversing rotation of the drive bevel gear 31 and transferring the reversed rotation to the driven bevel gear 32. A small-sized ship that does not require a high drive load may be actuated using only one reverse bevel gear.

Also, as illustrated in FIGS. 2 and 7, the counter-rotating device 30 includes an electric power supply device 60 configured to connect the rotation shaft 5 and the first connector 35 to be detachable from each other. The electric power supply device 60 includes a drive flange 61 provided on the rotation shaft 5 in front of the gear box 40, a driven flange 62 provided on the first connector 35 to be disposed opposite the drive flange 61, a friction member 63 disposed between the drive flange 61 and the driven flange 62, and a plurality of connecting bolts 64 for clamping the drive flange 61, the driven flange 62, and the friction member 63 while passing through them. The drive flange 61 may be integrally formed with the rotation shaft 5, or may be separately manufactured and fixed on the rotation shaft 5 by welding or the like. The driven flange 62 may be integrally formed with the first connector 35. The friction member 63 may be split into a plurality of semi-circulator parts so that the friction member 63 may be removed in an outer radial direction by loosening and removing the connecting bolts 64.

The electric power supply device 60 may be configured such that the plurality of connecting bolts 64 are loosened to separate the friction member 63 from the electric power supply device 60 to stop supply of power to the drive flange 61 and the driven flange 62 if needed. For example, when the counter-rotating device 30 malfunctions during an operation of the ship 1, supply of power to the first connector 35 from the rotation shaft 5 may be stopped. In this case, the ship 1 may be operated only by operating the rear propeller 20.

The second connector 36 includes a connecting flange 37 coupled to the hub 11 of the front propeller 10 at a read end thereof. The connecting flange 37 may be integrally formed with the second connector 36, and fixed on a front surface of the hub 11 of the front propeller 10 by clamping them with a plurality of clamp bolts 37*a*. Thus, rotation of the driven bevel gear 32 may be transferred to the front propeller 10 via the second connector 36.

A cylindrical third support ring 38*a* and a cylindrical fourth support ring 38*b* supporting the rear inner bearing 46 may be installed between the second connector 36 and an outer surface of the rotation shaft 5. The third support ring 38*a* may be disposed between an inner ring of the rear inner bearing 46 and an inner ring of the first thrust bearing 13 to maintain the distance between the inner ring of the rear inner bearing 46 and the inner ring of the first thrust bearing 13. The fourth support ring 38*b* may be installed on an inner surface of the second connector 36 to support an outer ring of the rear inner bearing 46. Also, the fixing ring 39 may be mounted at a rear end of the second connector 36 to prevent the fourth support ring 38*b* from being separated. The fixing ring 39 may support the outer ring of the first thrust bearing 13 as illustrated in FIGS. 2 and 5.

In the counter-rotating device 30, the first connector 35 rotates when the rotation shaft 5 rotates, and the drive bevel gear 31 coupled to the first connector 35 also rotates. The rotation of the drive bevel gear 31 is reversed by the plurality of reverse bevel gears 33 and transferred to the driven bevel gear 32. Thus, the driven bevel gear 32 rotates in a direction opposite to the rotational direction of the drive bevel gear 31. Also, the rotation of the driven bevel gear 32 is transferred to the front propeller 10 via the second connector 36. Thus, the front propeller 10 and the rear propeller 20 may rotate in opposite directions.

As described above, the counter-rotating device 30 according to the present invention causes the two propellers 10 and 20 to rotate in opposite directions using the plurality of bevel gears 31, 32, and 33, and may be thus smaller in volume than a general planetary gear type counter-rotating device according to the related art. Accordingly, the volume of the gear box 40 installed in the tail 3 of the ship 1 may be minimized.

A general planetary gear type counter-rotating device includes a sun gear installed on a rotation shaft, a planet gear installed at an outer side of the sun gear, and a cylindrical internal gear installed at an outer side of the planet gear, and thus has a relatively large volume. Also, the volume of the general planetary gear type counter-rotating device should be very large in consideration of rotation of the internal gear which is an outermost gear and an outer casing thereof. Thus, the general planetary gear type counter-rotating device is actually very difficult to install in a tail of a ship. Even if the general planetary gear type counter-rotating device is installed in the tail of the ship, the tail of the ship should be very large.

As illustrated in FIG. 2, a propelling apparatus according to the present embodiment includes a first sealing device 90 for sealing a space between the tail 3 of the ship 1 and the hub 11 of the front propeller 10 to protect them against seawater (or fresh water) or foreign substances, and a second sealing device 110 for sealing a space between the hub 11 of the front propeller 10 and the hub 21 of the rear propeller 20 for the same purpose.

As illustrated in FIG. 12, the first sealing device 90 may include a cylindrical first lining 91 installed on the connecting flange 37 of the second connector 36 fixed on the front surface of the hub 11 of the front propeller, and a cylindrical first sealing member 92 covering an outer surface of the first lining 91 in contact with an outer surface of the first lining 91 and one end of which is fixed on the rear cover 43.

The first sealing member 92 includes a plurality of packings 93*a*, 93*b*, and 93*c* installed on an inner surface thereof facing the first lining 91 to be spaced apart from one another in contact with an outer surface of the first lining 91, and a fluid path 95 via which a fluid is supplied to seal grooves between the packings 93*a*, 93*b*, and 93*c*. The fluid path 95 of the first sealing member 92 may be connected to a lubricant supply path 96 passing through the front of the gear box 40 and the rear covers 42 and 43 so as to supply a lubricant of a predetermined pressure to the front of the gear box 40 and the rear covers 42 and 43 (see FIG. 2). The packings 93*a*, 93*b*, and 93*c* are pressurized against the first lining 91 by supplying the lubricant of the predetermined pressure to the grooves between the packings 93*a*, 93*b*, and 93*c*, thereby preventing seawater or foreign substances from penetrating into the ship 1.

The first lining 91 may be split into a first member 91*a* and a second member 91*b*, both sides of which have semi-circular shape as illustrated in FIG. 13. A packing 91*d* may be inserted into split portions 91*c* of the first and second members 91*a* and 91*b* to seal the first and second members 91*a* and 91*b* when the first and second members 91*a* and 91*b* are combined with each other. A first binding unit 91*e* protruding from a side to another side is provided at a free end of a split portion of the first member 91*a*. A second binding unit 91*f* corresponding to the first binding unit 91*e* is provided at the second member 91*b* opposite to the first member 91*a* to be combined with the first binding unit 91*e*. Here, a clamp bolt 91*g* may be clamped to the first binding unit 91*e* and the second binding unit 91*f* to firmly couple them with each other. A flange unit 91*h* fixed on the connecting flange 37 may be firmly fixed on the hub 11 by clamping the flange unit 91*h* with a plurality of clamp bolts 91*i*. Although both ends of the first lining 91 are split to be easily installed, the first lining 91 is not limited thereto and may have a cylindrical shape in which the first member 91*a* and the second member 91*b* are integrally formed.

Similarly, the first sealing member 92 may be manufactured by stacking and fixing rings 92*a*, 92*b*, and 92*c*, which are formed in a semicircle shape, on an outer side of the first lining 91 in the direction of the length of the rotation shaft 5. The rings 92*a*, 92*b*, and 92*c* may be bound to one another by clamping them with bolts or welding.

As illustrated in FIG. 14, the second sealing device 110 may include a cylindrical second lining 111 installed on a front surface of the hub 21 of the rear propeller 20, and a cylindrical second sealing member 112 covering an outer surface of the second lining 111 in contact with the outer surface of the second lining 111 and one end of which is fixed on a rear end of the hub 11 of the front propeller. Similar to the first sealing member 92, the second sealing member 112 includes a plurality of packings 113*a*, 113*b*, and 113*c* installed therein, and a fluid path 115 via which a fluid is supplied to grooves between the packings 113*a*, 113*b*, and 113*c*.

The fluid path 115 of the second sealing member 112 may communicate with a lubricant path 120 provided on a location biased from a central portion of the rotation shaft 5. To this end, a first connecting fluid path 121 connecting the lubricant path 120 and an inner space 122 of the second lining 111 may be formed in the rotation shaft 5 in the direction of the radius of the rotation shaft 5, and a second connecting fluid path 123 communicating between the inner space 122 of the second lining 111 and the fluid path 115 of the second sealing member 112 may be formed in the hub 11 of the front propeller 10. Thus, the packings 113*a*, 113*b*, and 113*c* may be pressurized by a lubricant supplied toward the second sealing member 112 from the lubricant path 120, thereby sealing the packings 113*a*, 113*b*, and 113*c*.

A measurement through-hole 100 is formed in a central portion of the rotation shaft 5 in the axial direction to control centering of the gear box 40 when the gear box 40 is installed in the installation space 4 as illustrated in FIG. 2. The centering of the gear box 40 performed via the measurement through-hole 100 will be described below.

Similar to the first lining 91 and the first sealing member 92 of the first sealing device 90, the second lining 111 and the second sealing member 112 are formed in a semicircle shape and combined with each other after the rear propeller 20 is installed.

Although the lubricant path 120 is disposed as an independent fluid path on the location biased from the central portion of the rotation shaft 5 in the present embodiment, embodiments of the present invention are not limited thereto and a plurality of lubricant paths 120 may be disposed in a radial form around the central portion of the rotation shaft 5. Also, the lubricant path 120 may serve as lubricant supply path via which a lubricant is supplied from a lubricant supply device (not shown) installed in the ship 1, may lubricate the vicinity of the rotation shaft 5, or serve as a lubricant collecting path via which a lubricant supplied to a sealing device is collected to the lubricant supply device.

As illustrated in FIGS. 2 and 5, the front propeller 10 includes the ring type first sealing cover 71 mounted at the rear end of the hub 11 to seal a space between an outer surface of the rotation shaft 5 and an inner surface of the hub 11. The first sealing cover 71 includes a sealing member 71*a* for increasing an adhesion between an inner circumferential surface of the first sealing cover 71 and the outer surface of the rotation shaft 5. The first sealing cover 71 may prevent seawater from flowing into the gear box 40 even when the seawater penetrates into the inner space 122 of the second lining 111 due to a malfunction of the second sealing device 110. That is, the first sealing cover 71 may serve as a secondary barrier wall to more reliably prevent seawater from penetrating into the gear box 40.

Referring to FIG. 2, a second sealing cover 72 having a similar shape as that of the first sealing cover 71 may be installed on the driven flange 62 in front of the gear box 40 to seal between the driven flange 62 and an outer surface of the rotation shaft 5. The second sealing cover 72 may prevent a lubricant filled in the gear box 40 from leaking to the ship 1.

The counter-rotating device 30 may include a front-surface sealing cover 73 for covering a front surface of the front bearing 44 between the front cover 42 and the first connector 35 to seal the front bearing 44, and a rear-end sealing cover 74 for covering a rear end of the rear outer bearing 45 between the rear cover 43 and the second connector 36 to seal the rear outer bearing 45. The front-surface sealing cover 73 and the rear-end sealing cover 74 may be provided in a form similar as that of the first sealing cover 71 described above.

The front-surface sealing cover 73 and the rear-end sealing cover 74 may prevent a lubricant in the gear box 40 from leaking to the outside of the gear box 40. Furthermore, even if seawater penetrates into an inner space of the first lining 91 due to a malfunction of the first sealing device 90, the rear-end sealing cover 74 may serve as a secondary barrier wall preventing the seawater from flowing into the gear box 40, similar to the first sealing cover 71.

Also, a propelling apparatus according to the present embodiment may include a second radial bearing 81, a third thrust bearing 82, and a fourth thrust bearing 83 which support the rotation shaft 5 in front of the gear box 40. The second radial bearing 81 may be fixed on a first bearing support 86 in the ship 1 while being accommodated in a first bearing case 84. The third and fourth thrust bearings 82 and 83 may be also fixed on a second bearing support 87 in the ship 1 such that inner rings thereof are supported while being accommodated in a second bearing case 85.

The second radial bearing 81 supports the rotation shaft 5 in front of the gear box 40, thereby preventing the rotation shaft 5 from vibrating or shaking in a radial direction thereof. The third and fourth thrust bearings 82 and 83 transfer an axial-direction force, which is transferred to the rotation shaft 5 from the front and rear propellers 10 and 20, toward the ship 1. In particular, the third thrust bearing 82 transfers to the ship 1 a force applied from the rotation shaft 5 to the bow of the ship 1 when the ship 1 moves forward, and the fourth thrust bearing 83 transfers to the ship 1 a force applied from the rotation shaft 5 to the tail of the ship 1 when the ship 1 moves backward.

In FIG. 2, reference numeral '131' denotes a first cover ring for covering a space between the tail 3 of the ship 1 and the hub 11 of the front propeller 10 at an outer side of the first sealing device 90, and reference numeral '132' denotes a second cover ring for covering a space between the hub 11 of the front propeller 10 and the hub 21 of the rear propeller 20 at an outer side of the second sealing device 110. The first cover ring 131 may be fixed on the tail 3 of the ship 1 to be slightly spaced from the hub 11 of the front propeller 10 or may be fixed on hub 11 of the front propeller 10 to be slightly spaced from the tail 3 of the ship 1 so that the first cover ring 131 may rotate together with the front propeller 10. Similarly, the second cover ring 132 may be fixed on the hub 11 of the front propeller 10 or the hub 21 of the rear propeller 20, and rotate together with the front propeller 10 or the rear propeller 20 on which the second cover ring 132 is fixed.

Next, a method of manufacturing a propelling apparatus according to the present embodiment and installing the propelling apparatus in a ship will be described with reference to FIGS. 7 to 11 below.

As illustrated in FIG. 7, in order to install a propelling apparatus, the gear box 40 of the counter-rotating device 30, components related to the gear box 40, and the rotation shaft 5 are assembled together before the propelling apparatus is installed in the ship 1. That is, the body unit 41, the internal frame 50 in which the reverse bevel gears 33 are assembled, the drive bevel gear 31, the driven bevel gear 32, the first connector 35, the front cover 42, the front bearing 44, the second connector 36, the rear cover 43, the rear outer bearing 45, etc. are assembled together at an outer side of the rotation shaft 5. The first lining 91 and the first sealing member 92 of first sealing device 90 are also installed between the connecting flange 37 of the second connector 36 and the rear cover 43.

The counter-rotating device 30 may be precisely manufactured since components thereof may be manufactured and then assembled in a separate manufacturing plant. Also, the first sealing device 90 that should be generally installed after the front propeller 10 is installed may be mounted beforehand in the counter-rotating device 30, thereby simplifying a subsequent process of installing the propelling apparatus in the ship 1.

The rotation shaft 5 and the counter-rotating device 30 assembled in the manufacturing plant may be transferred to a dock where the ship 1 is manufactured or the like using a transportation means, and installed in the tail 3 of the ship 1. In this case, a lifting device, e.g., a crane, which is capable of lifting the assembly of the counter-rotating device 30 may be used. When the counter-rotating device 30 is mounted, first, the gear box 40 of the counter-rotating device 30 is loaded into the installation space 4 in the tail 3 of the ship 1 from the rear of the ship 1 in a sliding manner.

Then, the rotation shaft 5 and the main drive shaft 6 are aligned to each other such that the centers thereof coincide. That is, the main drive shaft 6 is connected to the drive source 8 such that the center of the main drive shaft 6 coincides with a (virtual) shaft line of the drive source 8. Thus, since the rotation shaft 5 is aligned such that the center thereof coincides with the center of the main drive shaft 6, the center of the rotation shaft 5 and the center of the main drive shaft 6 coincide with each other.

Referring to FIG. 8, a shaft alignment tester may be used to align the rotation shaft 5 and the main drive shaft 6 with each other such that the centers thereof coincide with each other.

In the shaft alignment tester, light is radiated to the measurement through-hole 100 of the rotation shaft 5 from the front of the rotation shaft 5 using a light radiation unit 210 (which will be described below), and a point on which the light passing through the measurement through-hole 100 of the rotation shaft 5 is incident is measured using an optical sensor unit 220 (which will be described below). Examples of the radiated light may include a laser ray, infrared light, etc.

The rotation shaft 5 is aligned with the main drive shaft 6 and coupled to the main drive shaft 6, based on a value measured by the shaft alignment tester. In this case, the front end of the rotation shaft 5 is coupled to the main drive shaft 6 to be detachable from the main drive shaft 6 as described above. Also, the main drive shaft 6 and the rotation shaft 5 may be coupled to each other, for example, by the cylindrical coupling device 7 by spline shaft coupling such that they can be separated from/coupled to each other.

Referring to FIG. 9, the shaft alignment tester includes the light radiation unit 210 and the optical sensor unit 220.

As illustrated in FIG. 9(*a*), the light radiation unit 210 radiates light to measurement through-hole 100 of the rotation shaft 5 from the center of the main drive shaft 6. The light radiation unit 210 may be installed at an inner side of the main drive shaft 6 or in front of the drive source 8 to be installed at an inner side of a tunnel bearing 9 (see FIG. 1) supporting the main drive shaft 6. Hereinafter, a case in which the light radiation unit 210 is installed at the inner side of the main drive shaft 6 will be described for convenience of explanation. Here, the tunnel bearing 9 is designed such that the center thereof coincides with the center of the main drive shaft 6 with respect to a shaft line, and may include, for example, a sleeve bearing.

The light radiation unit 210 includes a light source 211 and a first tiltmeter 212. The light source 211 radiates light. In this case, the light may be a laser ray, etc. The light source 211 radiates light in a horizontal direction that coincides with the center of the main drive shaft 6. In this case, the first tiltmeter 212 measures horizontality of a light radiation unit 210. By measuring the horizontality of the light radiation unit 210, whether the light is radiated from the light radiation unit 210 in the horizontal direction may be tested.

The height of the light radiation unit 210 may be adjusted using a first adjustment member 213 to control a reference position C1 at which light is to be radiated to coincide with the center of the main drive shaft 6. The reason why the height of the light radiation unit 210 is adjusted is to set the reference position C1 at which light is radiated to coincide with the center of the main drive shaft 6, so that light may be radiated onto a point that coincides with the center of the main drive shaft 6.

The first adjustment member 213 includes a first support bar 213*a* and a first leveler 213*b*. The height of the light radiation unit 210 may be adjusted by moving the light radiation unit 210 vertically along the first support bar 213*a* using the first leveler 213*b*. An operator may adjust the height of the light radiation unit 210 using an external device connected to the light radiation unit 210 while checking the coordinates of the reference position C1 of the light radiation unit 210, so that the reference position C1 of the light radiation unit 210 may coincide with the center of the main drive shaft 6.

The first support bar 213*a* is coupled to a first fixing unit 215. The light radiation unit 210 is fixed on an inner surface of the main drive shaft 6 using the first fixing unit 215. For example, since the bottom of the first fixing unit 215 is formed to correspond to an internal curvature of the main drive shaft 6, the first fixing unit 215 may thus enable the light radiation unit 210 to be stably fixed on the inner surface of the main drive shaft 6. The first fixing unit 215 may be formed of a magnetic substance, and thus enables the light radiation unit 210 to be installed to be attachable/detachable. However, embodiments of the present invention are not limited thereto, and the first fixing unit 215 may be attached by welding or the like.

As illustrated in FIG. 9(*b*), the optical sensor unit 220 is installed at the rotation shaft 5 or the rear of the rotation shaft 5 to face the light radiation unit 210, and measures a point on which light is incident. For example, the optical sensor unit 220 may be installed in a hollow portion of or a rear end 5*b* of the rotation shaft 5 to measure a point on which light is incident. The optical sensor unit 220 includes a light-receiving unit 221, a second tiltmeter 222, and a determination unit (not shown).

The light-receiving unit 221 detects the light incident from the light radiation unit 210. The light-receiving unit 221 may display the point on which light is incident on a screen thereof. An operator may check the point on which light is incident, which is displayed on the screen, and align the gear box 40 such that the center of the rotation shaft 5 and the center of the main drive shaft 6 coincide with each other. In this case, as another example, data regarding the coordinates of point on which light is incident may be transmitted to an external device. In this case, the operator may check a state in which the rotation shaft 5 and the main drive shaft 6 are aligned to each other, based on the coordinates displayed on the external device.

The second tiltmeter 222 measures the horizontality of the optical sensor unit 220, so that the light radiation unit 210 and the optical sensor unit 220 may radiate light and receive the light in the horizontal direction.

The determination unit determines whether the center of the rotation shaft 5 and the center of the main drive shaft 6 are aligned to each other, based on the point on which light is incident. The determination unit determines that the center of the rotation shaft 5 and the center of the main drive shaft 6 are aligned to each other when light is incident on a reference position C2 of the optical sensor unit 220 that coincides with the reference position C1 of the light radiation unit 210 radiating light. Here, the reference position C2 of the optical sensor unit 220 is set to coincide with the center of the rotation shaft 5. When it is determined that the center of the rotation shaft 5 and the center of the main drive shaft 6 are aligned to each other, this fact may be informed to the operator using an alarm, etc.

The height of the optical sensor unit 220 may be adjusted by a second adjustment member 223 such that the reference position C2 on which light is incident coincides with the center of the rotation shaft 5. The second adjustment member 223 includes a second support bar 223*a* and a second leveler 223*b*. The height of the optical sensor unit 220 may be adjusted by moving the optical sensor unit 220 vertically along the second support bar 223*a* using the second leveler 223*b*. An operator may adjust the height of the optical sensor unit 220 using an external device connected to the optical sensor unit 220 while checking the coordinates of the reference position C2 of the optical sensor unit 220, so that the reference position C2 of the optical sensor unit 220 may coincide with the center of the rotation shaft 5.

The second support bar 223*a* is coupled to a second fixing unit 225. The optical sensor unit 220 is fixed on a rear end surface of the rotation shaft 5 using the second fixing unit 225. The second fixing unit 225 may be formed of a magnetic substance and thus enables the optical sensor unit 220 to be installed to be attachable/detachable. However, embodiments of the present invention is not limited thereto and the second fixing unit 225 may be attached by welding, using a clamp means, etc.

When it seems that the shafts 5 and 6 are misaligned to each other, the shaft alignment tester may measure an alignment state between the shafts 5 and 6 by radiating and receiving light periodically or according to a control command received from an external device, and provide a result of the measurement to the external device. To this end, the light radiation unit 210 and the optical sensor unit 220 may each include a controller (not shown). For example, the controller of the light radiation unit 210 causes the light radiation unit 210 to radiate light periodically or according to a control command transmitted from the external device, and the controller of the optical sensor unit 220 measures a point on which the received light is incident and provides a result of the measurement to the external device.

FIG. 10(*a*) illustrates a structure in which the optical sensor unit 220 is fixed at the rear end of the rotation shaft 5. Referring to FIG. 10(*b*), when measurement using the shaft alignment tester is completed, the rear end of the rotation shaft 5 is closed by a sealing cap 230.

As described above, since the rotation shaft 5 and the main drive shaft 6 are aligned with each other using the shaft alignment tester such that the centers thereof coincide with each other, the precision and efficiency of aligning the shafts 5 and 6 may be increased and the shafts 5 and 6 may be prevented from being fatigued, damaged, and vibrating.

After the counter-rotating device 30 is loaded and arranged in the installation space 4 of the tail 3 of the ship 1, a front fixing member 48*a* and a rear fixing member 48*b* are respectively installed on the front and rear of the gear box 40 to fix the gear box 40 in the tail 3 of the ship 1 as illustrated in FIG. 11. The front and rear fixing members 48*a* and 48*b* may be split into several parts. The front and rear fixing members 48*a* and 48*b* may be fixed on a structure including the gear box 40 and the tail 3 of the ship 1 by clamping them with a plurality of clamp bolts.

An operator may exactly install the rear fixing member 48*b* by accessing the rear of the ship 1, and the front fixing member 48*a* by accessing the inside of the ship 1. As described above, the counter-rotating device 30 installed by being loaded in the installation space 4 of the tail 3 of the ship 1 may be separated from the ship 1 and repaired when the counter-rotating device 30 malfunctions. Accordingly, the counter-rotating device 30 is easy to repair.

In the present embodiment, the front fixing member 48*a* and the rear fixing member 48*b* are clamped to the front and rear of the gear box 40 in order to firmly fix the gear box 40. However, when the gear box 40 is loaded in the installation space 4, an outer surface of the gear box 40 is continuously supported by an inner surface of the installation space 4 and thus the gear box 40 may be fixed in the tail 3 of the ship 1 by clamping only the rear fixing member 48*b* thereto.

After the gear box 40 is fixed in the tail 3 of the ship 1, the main drive shaft 6 and the rotation shaft 5 are coupled by the coupling device 7, and the second radial bearing 81 and the third and fourth thrust bearings 82 and 83 are installed in the ship 1 to support the rotation shaft 5 in the ship 1.

After the counter-rotating device 30 is installed in the tail 3 of the ship 1, the front propeller 10 and the rear propeller 20 and other components related thereto may be installed on the rotation shaft 5, and the second sealing device 110 may be installed as illustrated in FIGS. 1 and 2, thereby completing installation of the propelling apparatus.

As described above, the gear box 40 mounted in the installation space 4 of the tail 3 of the ship 1 may malfunction and should be thus separated from the installation space 4 to be repaired. However, the gear box 40 weighs at least several tens of tons and is thus difficult to be separated from installation space 4. Thus, there is a growing need to efficiently separate the gear box 40 from the installation space 4.

To this end, referring to FIG. 20, the front fixing member 48*a* may include a first clamp groove 2201, a second clamp groove 2202, and a separation groove 2211. The front fixing member 48*a* is fixed on the tail 3 of the ship 1 by screwing a clamp bolt 2208 into the first clamp groove 2201. Also, the gear box 40 is fixed on the tail 3 of the ship 1 by screwing a clamp bolt 2209 into the second clamp groove 2202. In this case, when the gear box 40 is loaded in the installation space 4, an outer surface of the gear box 40 is continuously supported by an inner surface of the installation space 4 and thus the gear box 40 may be thus fixed on the tail 3 of the ship 1 by simply clamping only the rear fixing member 48*b* thereto. In this case, the second clamp groove 2202 and the clamp bolt 2209 clamped thereto may be omitted.

In order to separate the gear box 40 from the installation space 4, the clamp bolt 2209 is loosened from the rear fixing member 48*b* (see FIG. 8) while the front fixing member 48*a* is coupled to the tail 3 of the ship 1. Then, when a jack bolt 2212 which will be described below is screwed into the separation groove 2211 and moved forward to apply a force to the front cover 42, the gear box 40 is separated from the installation space 4. Here, that the gear box 40 is separated from the installation space 4 by screwing the jack bolt 2212 into the separation groove 2211 may be understood to include moving the gear box 40 to be spaced by a predetermine distance from the installation space 4 by screwing the jack bolt 2212 into the separation groove 2211.

Referring to FIG. 21, the front fixing member 48*a* may be provided in the form of a fixing flange 2210. Similar to the front fixing member 48*a*, the separation groove 2211 which is a through-groove is formed in the fixing flange 2210 in front of the gear box 40 to separate the gear box 40 from the installation space 4 when a force is applied to the gear box 40 by screwing a bolt into the separation groove 2211. In this case, the fixing flange 2210 may be coupled to the tail 3 of the ship 1 by welding or clamping them with a bolt or may be integrally formed with the tail 3 of the ship 1.

Referring to FIGS. 22 and 23, a plurality of separation grooves 2211 may be formed along a marginal portion 2213 of the fixing flange 2210 which is closely in contact with the front cover 42 of the gear box 40. The gear box 40 may be separated from the installation space 4 by screwing the jack bolt 2212 into each of the separation grooves 2211 formed along the marginal portion 2213 of the fixing flange 2210 and moving the jack bolt 2212 by applying a force to the front cover 42 in a state in which the rear fixing member 48*b* (see FIG. 8) is unclamped from the gear box 40. In the present embodiment, a case in which the jack bolt 2212 is used has been described above, but embodiments of the present invention are not limited thereto and various other clamp means may be used provided that they can be used to apply a force to the front cover 42 clamped into the separation groove 2211 in order to separate the gear box 40 from the installation space 4.

Referring to FIG. 24, as another example, the fixing flange 2210 may be provided in a form including the clamp grooves 2202 and separation grooves 2211 as describe above. That is, the marginal portion 2213 of the fixing flange 2210 may include the clamp grooves 2202 which are through-grooves into which clamp bolts (not shown) are screwed in order to fix the gear box 40 on the tail 3 of the ship 1. In this case, the separation grooves 2211 and the clamp grooves 2202 may be alternately formed.

In this case, in order to separate the gear box 40 from the installation space 4, the rear fixing member 48*b* (see FIG. 8) is unclamped and the clamp bolts are unscrewed from the clamp grooves 2202. Next, the jack bolt 2212 is screwed in each of the separation grooves 2211 formed in the marginal portion 2213 of the fixing flange 2210 and moved forward by applying a force to the front cover 42 to separate the gear box 40 from the installation space 4.

The structure of the marginal portion 2213 of the fixing flange 2210 described above with reference to FIGS. 22 and 24 is also applicable to a marginal portion of the front fixing member 48*a* of FIG. 20 that is closely in contact with the front cover 42 of the gear box 40.

Referring to FIGS. 25 and 26, the separation groove 2211 of FIG. 22 may also serve as a clamp groove into which a clamp bolt 2209*a* is inserted to fix the gear box 40 on the tail 3 of the ship 1. In this case, it is assumed that the diameter of the jack bolt 2212 is greater than that of the clamp bolt 2209*a*.

To this end, a coupling member 2220 including a screw thread in inner and outer marginal portions thereof may be coupled to the separation groove 2211. The coupling member 2220 includes a hollow portion 2220*a* into which the clamp bolt 2209*a* is inserted to fix the front of the gear box 40 on the tail 3 of the ship 1. An inner shape of the separation groove 2211 corresponds to a shape of the coupling member 2220. The clamp bolt 2209*a* may be formed in a shape including a screw thread corresponding to an inner shape coupling member 2220.

To fix the gear box 40 on the tail 3 of the ship 1, the coupling member 2220 is coupled to the separation groove 2211, and the clamp bolt 2209*a* is inserted into the coupling member 2220 to couple the coupling member 2220 to a groove 42*a* formed in a front surface of the front cover 42 of the gear box 40. Then, in order to separate the gear box 40 from the installation space 4, the rear fixing member 48*b* (see FIG. 8) is unclamped, the clamp bolt 2209*a* and the coupling member 2220 are sequentially loosened from the separation groove 2211, and the jack bolt 2212 is inserted into the separation groove 2211 and moved forward to apply a force to the gear box 40. In this case, the jack bolt 2212 may be formed in a shape corresponding to the inner shape of the separation groove 2211 so that the jack bolt 2212 may be inserted into the separation groove 2211.

Next, an operation of a propelling apparatus according to the present invention will be described.

In the propelling apparatus, when the rotation shaft 5 rotates as the drive source 8 included in the ship 1 operates, the rear propeller 20 coupled directly to the rear end of the rotation shaft 5 rotates together with the rotation shaft 5 in a direction in which the rotation shaft 5 rotates. At the same time, the drive bevel gear 31 of the counter-rotating device 30 rotates together with the rotation shaft 5 since it is fixed on the rotation shaft 5. The rotation of the drive bevel gear 31 is reversed by the plurality of reverse bevel gears 33 and transferred to the driven bevel gear 32. Thus, the driven bevel gear 32 rotates in a direction opposite to the rotational direction of the rotation shaft 5. Thus, the front propeller 10 coupled to the driven bevel gear 32 via the second connector 36 rotates in a direction opposite to the rotational direction of the rear propeller 20.

The front propeller 10 and the rear propeller 20 that rotate in opposite directions have different wing angles and thus generate propelling water flows in the same direction. That is, the front propeller 10 and the rear propeller 20 generate propelling water flows in a backward direction when the ship 1 moves forward, and generate propelling water flows in a forward direction while rotating reversely when the ship moves backward. Propelling water flows generated when the ship 1 moves forward collect as a propulsive force the rotational energy of a liquid passing through the front propeller 10 when the rear propeller 20 rotates reversely, thereby improving the propelling performance of the ship 1. This also applies when the ship 1 moves backward.

When the ship 1 moves forward, the front propeller 10 generates propelling water flows in the backward direction and thus a reaction force corresponding the propelling water flows is applied to the front propeller 10. The reaction force is transferred to the rotation shaft 5 via the second thrust bearing 14 and used as a propulsive force. When the ship 1 moves forward, the rear propeller 20 also generates propelling water flows in the backward direction and a reaction force is applied thereto. The reaction force is also transferred to the rotation shaft 5 directly coupled to the rear propeller 20 and used as a propulsive force.

When the ship 1 moves backward, a propulsive force generated by the front propeller 10 is transferred to the rotation shaft 5 via the first thrust bearing 13, and a propulsive force generated by the rear propeller 20 is transferred to the rotation shaft 5 coupled directly to the rear propeller 20.

Accordingly, in the propelling apparatus according to the present embodiment, propulsive forces generated by operating the front propeller 10 and the rear propeller 20 are transferred to the rotation shaft 5 when the ship 1 moves forward and backward. The propulsive forces transferred to the rotation shaft 5 are transferred to the ship 1 via the third and fourth thrust bearings 82 and 83, thereby propelling the ship 1 to move.

A sealing device installed between a front propeller and a rear propeller according to another embodiment of the present invention will now be described. Elements having the same functions as those of the elements in the previous embodiments will be denoted by the same reference numerals and will not be described in detail.

Referring to FIGS. 15 to 19, a sealing device 1110 according to another embodiment of the present invention includes a pressurizing ring member 1120 and a support ring member 1130 that are in surface contact with each other in a sliding manner to enhance the sealing performance of the sealing device 1110 by preventing a sealing efficiency from being degraded even when the front propeller 10 and the rear propeller 20 that rotate in opposite directions move in a direction of the radius of the rotation shaft 5 due to non-uniform load applied thereto.

The pressurizing ring member 1120 is configured to apply pressure against the support ring member 1130. The pressurizing ring member 1120 includes a fixing ring 1121 coupled to the hub 21 of the rear propeller 20, a moving ring 1125 including a pressurizing unit 1123 that is disposed apart from the fixing ring 1121 and that is in surface contact with the support ring member 1130, and an elastic unit 1127 coupled between the fixing ring 1121 and the moving ring 1125 to apply pressure onto the moving ring 1125 toward the support ring member 1130.

The fixing ring 1121 is formed in a hollow cylindrical shape, and one end of the fixing ring 1121 is fixedly coupled to the hub 21 of the rear propeller 20 via a fixing member 1124 such as a bolt to form a watertight construction. The moving ring 1125 is spaced apart by a predetermined distance from the fixing ring 1121 in the axial direction of the rotation shaft 5, and has a hollow cylindrical shape surrounding the outer surface of the rotation shaft 5.

The elastic unit 1127 includes a pair of fixing portions 1127*a* and 1127*b*, both ends of which are coupled to an outer surface of the fixing ring 1121 and an outer surface of the moving ring 1125 in a watertight construction so as to seal between the fixing ring 1121 and the moving ring 1125, and a circular arc portion 1127*c* connects the pair of fixing portions 1127*a* and 1127*b* and providing an elastic force.

That is, the pair of fixing portions 1127*a* and 1127*b* are pressurized to be in contact with each other by a support 1127*d* to form a watertight construction and are thus coupled to the outer surfaces of the fixing ring 1121 and the moving ring 1125, respectively. The circular arc portion 1127*c* may be bent to a predetermined curvature to provide an elastic force for pressurizing the moving ring 1125.

The elastic unit 1127 according to the present embodiment is not limited thereto and various well-known means may be used as the elastic unit 1127 provided that they can generate pressure applied toward the support ring member 1130.

The pressurizing unit 1123 may have a cylindrical shape and be coupled to a side of the moving ring 1125 to be detachable from the moving ring 1125.

The pressurizing unit 1123 causes friction rotation to occur when it is in surface contact with the support ring member 1130, and is formed of a material having high wear resistance. A sliding surface 1123*a* of the pressurizing unit 1123 that is in surface contact with the support ring member 1130 may be formed to be perpendicular to the rotation shaft 5.

A sealing unit 1128 may be provided between the pressurizing unit 1123 and the moving ring 1125 to prevent seawater from penetrating between the pressurizing unit 1123 and the moving ring 1125.

Although the pressurizing unit 1123 is configured to be detachable from the moving ring 1125 in the present embodiment, the pressurizing unit 1123 may be formed integrally with the moving ring 1125.

The support ring member 1130 has a cylindrical shape coupled to the hub 11 of the front propeller 10 via a fixing member 1129 such as a bolt. In this case, support ring member 1130 is also coupled to the hub 11 of the front propeller 10 to form a watertight construction.

A rear surface of the support ring member 1130 may be a sliding surface 1131 formed in parallel with a direction perpendicular to the rotation shaft 5 to be in surface contact with the sliding surface 1123*a* of the pressurizing unit 1123. The support ring member 1130 may be also formed of a material having high wear resistance.

Due to the above structure, even if the front propeller 10 and the rear propeller 20 move in the direction of the radius of the rotation shaft 5 due to a non-uniform load applied thereto, the sliding surface 1123*a* of the pressurizing ring member 1120 and the sliding surface 1131 of the support ring member 1130 that are pressurized against each other to be in friction contact with each other in a sliding manner are capable of absorbing the movement of the front propeller 10 and the rear propeller 20 in the direction of the radius of the rotation shaft 5, thereby enhancing the reliability of the sealing performance.

The sealing device 1110 performing a sealing function using friction rotation by the sliding surfaces 1123*a* and 1131 according to the present embodiment may be supplied a lubricant from a lubricant supply device 1140 loaded in the ship 1 to prevent the performance of the sealing device 1110 from being degraded due to frictional heat, as illustrated in FIG. 17.

The lubricant supply device 1140 includes a lubricant tank 1141 storing a lubricant, a lubricant supply line 1142 for supplying the lubricant from the lubricant tank 1141 to an inner space 1122 of the sealing device 1110, and a lubricant collecting line 1143 for collecting the lubricant from the inner space 1122 of the sealing device 1110.

The lubricant supply line 1142 is coupled to a lubricant supply path 1150 formed in the rotation shaft 5. The lubricant collecting line 1143 is coupled to a lubricant collecting path 1160 formed in the rotation shaft 5.

One end of the lubricant supply path 1150 may be coupled to a lubricant supply unit 1151 installed on the rotation shaft 5, and another end of lubricant supply path 1150 may be coupled to the inner space 1122 formed between the rotation shaft 5 and the sealing device 1110 so as to communicate with the inner space 1122.

One end of the lubricant collecting path 1160 may be coupled to a lubricant collecting unit 1161 installed on the rotation shaft 5, and another end of the lubricant collecting path 1160 may be coupled to a connecting fluid path 1170 formed in the hub 21 of the rear propeller 20 to communicate with the connecting fluid path 1170.

The connecting fluid path 1170 is a pipe line connecting the lubricant collecting path 1160 and the inner space 1122. One end 1171 of the connecting fluid path 1170 may be connected to the inner space 1122, and another end 1173 of the connecting fluid path 1170 may be connected to an opening hole 1162 formed in an end portion of the lubricant collecting unit 1161.

Also, the other end 1173 (hereinafter referred to as a 'communication hole') of the connecting fluid path 1170 connected to the opening hole 1162 may have a width W2 that is greater than a width W1 of the opening hole 1162 as illustrated in FIG. 18.

As illustrated in FIG. 19, the length of the rotation shaft 5 is changed due to thermal stress caused by seasonal variations and the change in the length of the rotation shaft 5 results in a change in the location of the opening hole 1162 connected to the communication hole 1173 when the rear propeller 20 is coupled to the rotation shaft 5. However, the change in the location of opening hole 1162 may be compensated using the communication hole 1173 that is relatively wider.

The width W2 of the communication hole 1173 may be twice to four times the width W1 of the opening hole 1162.

Although the communication hole 1173 of the connecting fluid path 1170 formed in the hub 21 of the rear propeller 20 is described as wider than the opening hole 1162 of the lubricant collecting path 1160 formed in the rotation shaft 5 in the present embodiment, embodiments of the present invention are not limited thereto.

For example, various structures including a fluid path for supplying a lubricant to a sealing device connected to a hub of a propeller via the hub of the propeller may be used.

That is, in a structure in which a fluid path 1160 through which a lubricant flows (which is not limited to a lubricant collecting path herein) is formed in the rotation shaft 5 and the connecting fluid path 1170 connected to the fluid path 1160 is formed in the hub 21 of a propeller (which is not limited to a rear propeller), the communication hole 1173 of the connecting fluid path 1170 connected to the opening hole 1162 of the fluid path 1160 is formed to be wider than the opening hole 1162.

Referring back to FIGS. 16 and 17, the lubricant supply device 1140 may further include a pump 1144 and a cooling device 1145 that are installed at the lubricant supply line 1142, and a valve 1146, an oil separator 1147, and a filter 1148 that are installed at the lubricant collecting line 1143.

The pump 1144 pumps a lubricant stored in the lubricant tank 1141, squeeze-pumps the lubricant to the lubricant supply unit 1151 via the lubricant supply line 1142. The lubricant pumped by the pump 1144 is cooled by the cooling device 1145 and transferred to the inner space 1122 of the sealing device 1110 via the lubricant supply path 1150.

The lubricant transferred to the inner space 1122 cools the sealing device 1110, passes through the connecting fluid path 1170 and the lubricant collecting path 1160, and returns to the lubricant collecting line 1143 via the lubricant collecting unit 1161.

In this case, seawater may flow into the inner space 1122 of the sealing device 1110 via a gap between the sliding surfaces 1123*a* and 1131. The seawater flown into the inner space 1122 is mixed with the lubricant in the inner space 1122 and collected via the lubricant collecting line 1143.

The oil separator 1147 installed at the lubricant collecting line 1143 separates the seawater from the lubricant mixed with the seawater. Foreign substances are removed from the lubricant from which the seawater is separated by the filter 1148, and the lubricant is collected again to the lubricant tank 1141.

Although the present invention has been particularly shown and described with reference to exemplary embodiments thereof, the present invention is not limited thereto. It will be understood by those of ordinary skill in the art that various changes in form and details may be made therein without departing from the spirit and scope of the invention as defined by the appended claims.

The invention claimed is:

1. A ship propelling apparatus comprising:

a rear propeller fixed on a rotation shaft;

a front propeller supported rotatably on the rotation shaft in front of the rear propeller; and a counter-rotating device configured to reverse rotation of the rotation shaft and transfer the reversed rotation to the front propeller, wherein the counter-rotating device comprises a gear box including therein a plurality of gears for reversing rotation of the front propeller and accommodated in an installation space formed in a tail of a ship, and a fixing flange provided at the front of the gear box, and including a separation groove which is a through-groove, wherein the separation groove is selectively coupled to a jack bolt which applies a pushing force to a front cover of the gear box to separate from the installation space; and a coupling member includes a hollow portion which a clamp bolt coupled to a groove formed in the front cover to fix the gear box on the tail of the ship is inserted to.

2. The ship propelling apparatus of claim 1, wherein a plurality of separation grooves are formed along a marginal portion of the fixing flange that is in close contact with the gear box.

3. The ship propelling apparatus of claim 2, wherein the gear box is separated from the installation space due to a force applied to the gear box by the jack bolt inserted into at least one of the separation grooves in a state in which the clamp bolt and the coupling member are loosened from all of the separation grooves.

4. The ship propelling apparatus of claim 2, wherein a marginal portion of the fixing flange that is in close contact with the gear box comprises:

clamp grooves into which clamp bolts are inserted; and the separation grooves formed alternately with the clamp grooves.

5. The ship propelling apparatus of claim 4, wherein the gear box is separated from the installation space due to a force applied to the front cover by the jack bolt inserted into at least one of the separation grooves in a state in which the clamp bolts are loosened from all of the clamp grooves.

6. The ship propelling apparatus of claim 1, wherein the fixing flange is coupled to the tail of the ship or formed integrally with the tail of the ship.

* * * * *